US010900688B2

(12) United States Patent
Komatsu et al.

(10) Patent No.: US 10,900,688 B2
(45) Date of Patent: Jan. 26, 2021

(54) INDOOR UNIT OF AIR CONDITIONER

(71) Applicant: DAIKIN INDUSTRIES, LTD., Osaka (JP)

(72) Inventors: Akira Komatsu, Osaka (JP); Nobuyuki Kojima, Osaka (JP); Ryouta Suhara, Osaka (JP); Masaaki Murata, Osaka (JP); Natsumi Furo, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 15/759,136

(22) PCT Filed: Aug. 9, 2016

(86) PCT No.: PCT/JP2016/003678
§ 371 (c)(1),
(2) Date: Mar. 9, 2018

(87) PCT Pub. No.: WO2017/056365
PCT Pub. Date: Apr. 6, 2017

(65) Prior Publication Data

US 2019/0056137 A1 Feb. 21, 2019

(30) Foreign Application Priority Data

Sep. 29, 2015 (JP) ..... 2015-191915
Jan. 29, 2016 (JP) ..... 2016-015305

(51) Int. Cl.
*F24F 11/65* (2018.01)
*F24F 1/0014* (2019.01)
(Continued)

(52) U.S. Cl.
CPC ..... *F24F 11/65* (2018.01); *F24F 1/0014* (2013.01); *F24F 11/72* (2018.01); *F24F 11/74* (2018.01);
(Continued)

(58) Field of Classification Search
CPC ..... F24F 11/65; F24F 11/72; F24F 11/755; F24F 11/74; F24F 11/745; F24F 11/79; F24F 1/0014; F24F 1/0047; F24F 2221/14
See application file for complete search history.

(56) References Cited

U.S. PATENT DOCUMENTS 4,259,898 A * 4/1981 Finkelstein ..... F24F 11/745 454/292
4,460,036 A * 7/1984 Yoshimi ..... B60H 1/00842 165/203
(Continued)

FOREIGN PATENT DOCUMENTS

CN 102597646 A 7/2012
EP 2498018 A1 9/2012
(Continued)

OTHER PUBLICATIONS

International Search Report for PCT/JP2016/003678(PCT/ISA/210) dated Nov. 1, 2016.

*Primary Examiner* — Nelson J Nieves
(74) *Attorney, Agent, or Firm* — Birch, Stewart, Kolasch & Birch, LLP

(57) ABSTRACT

The indoor unit includes a plurality of outlet openings. In airflow rotation of the indoor unit, a full blowout mode and a partial blowout mode are executed. In the full blowout mode, all the outlet openings blow conditioned air. In the partial blowout mode, the flow of the blowing air of part of the outlet openings are blocked by the air current blocking mechanism, and thus the blowing wind speeds of the remaining outlet openings increases. As a result, an air temperature difference among parts of the indoor space decreases, and the comfort of the indoor space is improved.

11 Claims, 13 Drawing Sheets

(51) Int. Cl.

| | |
|---|---|
| ***F24F 11/79*** | (2018.01) |
| ***F24F 11/74*** | (2018.01) |
| ***F24F 11/89*** | (2018.01) |
| ***F24F 11/72*** | (2018.01) |
| ***F25B 29/00*** | (2006.01) |
| *F24F 13/14* | (2006.01) |
| *F24F 13/20* | (2006.01) |
| *F24F 110/10* | (2018.01) |
| *F24F 130/00* | (2018.01) |
| *F24F 140/20* | (2018.01) |
| *F24F 13/22* | (2006.01) |
| *F24F 140/50* | (2018.01) |
| *F24F 1/0047* | (2019.01) |

(52) U.S. Cl.

CPC ..... *F24F 11/79* (2018.01); *F24F 11/89* (2018.01); *F25B 29/003* (2013.01); *F24F 1/0047* (2019.02); *F24F 13/14* (2013.01); *F24F 13/20* (2013.01); *F24F 13/222* (2013.01); *F24F 2110/10* (2018.01); *F24F 2130/00* (2018.01); *F24F 2140/20* (2018.01); *F24F 2140/50* (2018.01)

(56) References Cited

U.S. PATENT DOCUMENTS 5,725,148 A * 3/1998 Hartman ..... F24F 3/044 236/49.3
6,079,626 A * 6/2000 Hartman ..... F24F 3/044 236/13
2008/0254734 A1* 10/2008 Uenaka ..... F24F 1/0007 454/256
2012/0174608 A1* 7/2012 Kumamoto ..... F24F 1/0011 62/186
2012/0187201 A1* 7/2012 Kawai ..... F24F 11/30 236/51
2012/0220212 A1* 8/2012 Tsuji ..... F24F 11/30 454/333
2012/0225618 A1* 9/2012 Nouchi ..... F24F 1/0011 454/258
2015/0153063 A1* 6/2015 Yasutomi ..... F24F 1/0011 454/241
2018/0283725 A1* 10/2018 Ikawa ..... F24F 3/14

FOREIGN PATENT DOCUMENTS

| | | | |
|---|---|---|---|
| EP | 2498019 | A1 | 9/2012 |
| EP | 2530395 | A1 | 12/2012 |
| EP | 2982911 | A1 | 2/2016 |
| JP | 2000-104979 | A | 4/2000 |
| JP | 2001-133019 | A | 5/2001 |
| JP | 2001-304666 | A | 10/2001 |
| JP | 2002-277034 | A | 9/2002 |
| JP | 2005-016863 | A | 1/2005 |
| JP | 2005-016885 | A | 1/2005 |
| JP | 2007-024453 | A | 2/2007 |
| JP | 2011-052932 | A | 3/2011 |
| JP | 2011-52958 | A | 3/2011 |
| JP | 2015-052431 | A | 3/2015 |
| JP | 2015-094473 | A | 5/2015 |
| JP | 2015-105768 | A | 6/2015 |
| WO | WO 2014/162975 | A1 | 10/2014 |

* cited by examiner

FIG.10A
(CONVENTIONAL)
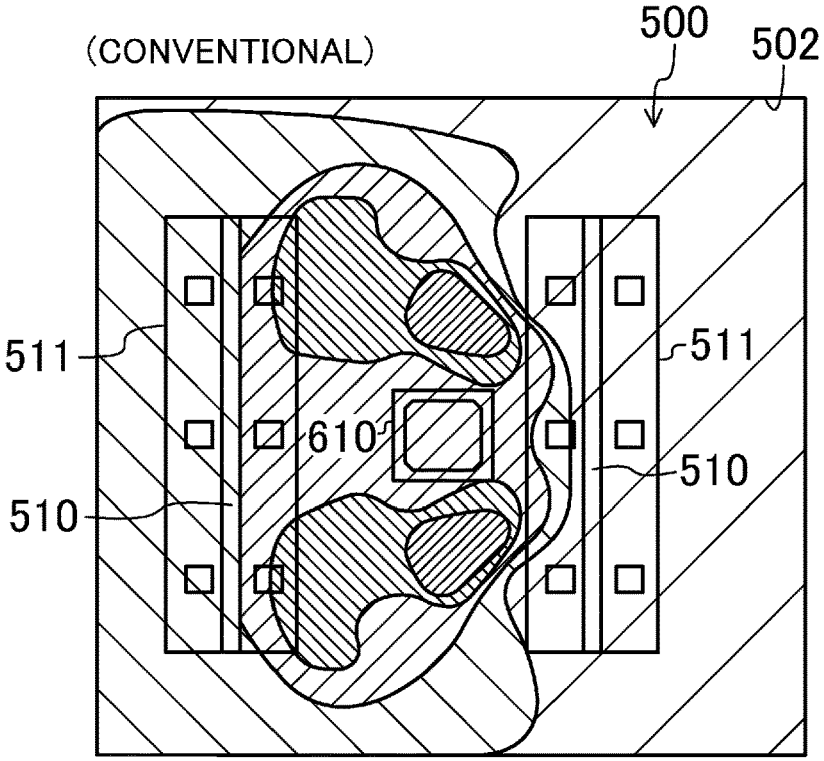
(EMBODIMENT)

FIG.11A
(CONVENTIONAL)
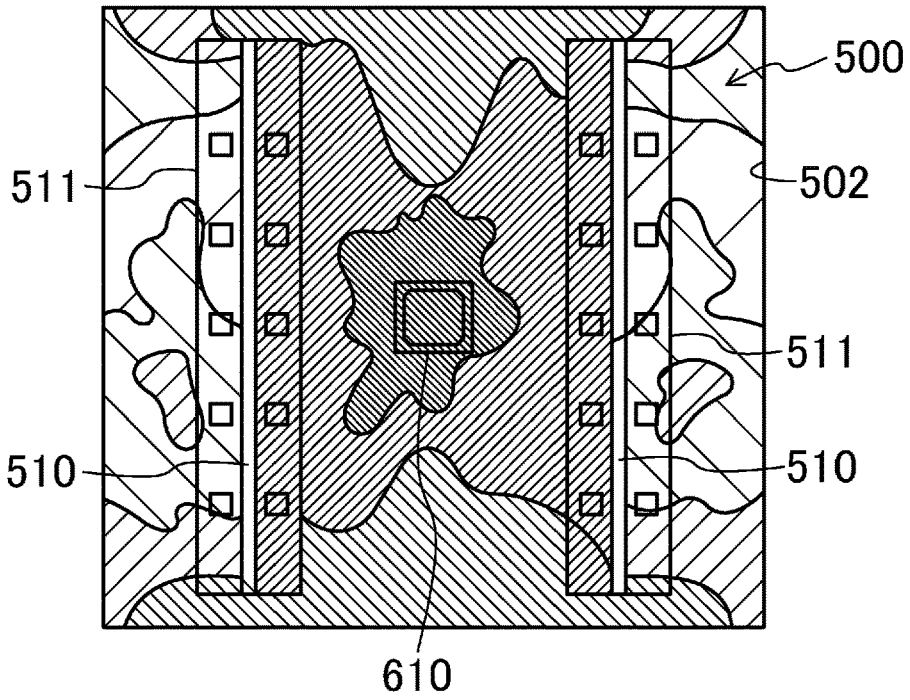
(EMBODIMENT)

INDOOR UNIT OF AIR CONDITIONER

TECHNICAL FIELD

The present invention relates to an indoor unit of an air conditioner provided on a ceiling.

BACKGROUND ART

For example, Patent Document 1 discloses a typical indoor unit of an air conditioner. The indoor unit of this type is provided on or around a ceiling, and blows heated or cooled air to an indoor space.

CITATION LIST

Patent Document

Patent Document 1: Japanese Unexamined Patent Publication No. 2015-094473

SUMMARY OF THE INVENTION

Technical Problem

The indoor unit of this type includes a plurality of blowing outlets, and, as a general rule, blows air from all the blowing outlets during operations. If the blowing wind speed at the blowing outlet (i.e., the flow speed of the air blown out from the blowing outlet) is low, warm air or cool air stays only in a region relatively close to the indoor unit. Thus, an air temperature difference among parts of the indoor space increases, and the comfort of the room is reduced.

To address this problem, it is conceivable to increase the blowing wind speed to allow the flow of the blowing air (i.e., the flow of the air blown out from the blowing outlet) to reach a place away from the indoor unit. However, if the blowing wind speed increases, the blowing air continues to directly hit on a body of a person in the room, and the discomfort may be given. In other words, the comfort in the room cannot be improved by simply increasing the blowing wind speed.

In view of the foregoing, it is an object of the present invention to reduce discomfort caused by direct hitting of blowing air on a body in a room, and also reduce an air temperature difference among parts of an indoor space to improve comfort in the room.

Solution to the Problem

A first aspect of the present disclosure is directed to an indoor unit of an air conditioner installed on a ceiling (501) for blowing conditioned air into an indoor space (500). The indoor unit includes a plurality of outlet openings (24*a* to 24*d*) each provided with an air current blocking mechanism (50) blocking a flow of the conditioned air; and a controller (90) controlling the air current blocking mechanism (50) to execute airflow rotation to switch an operation between a full blowout mode of supplying the conditioned air from all the outlet openings (24*a* to 24*d*) to the indoor space (500) and a partial blowout mode of blocking flow of blowing air of part of the outlet openings (24*a* to 24*d*) by the air current blocking mechanism (50) and increasing a blowing wind speed at the part of outlet openings (24*a* to 24*d*).

The indoor unit (10) of the first aspect can execute the full blowout mode and the partial blowout mode. In the full blowout mode. the conditioned air is supplied from all the outlet openings (24*a* to 24*d*) to the indoor space (500). In the partial blowout mode, the flow of blowing air of part of the outlet openings (24*a* to 24*d*) formed in the indoor unit (10) are blocked by the air current blocking mechanism (50). As a result, the blowing wind speeds of the remaining outlet openings (24*a* to 24*d*) formed in the indoor unit (10) are higher than during the full blowout mode, and the flow of the blowing air reaches a region relatively far from the indoor unit (10) in the indoor space (500). During the partial blowout mode, the conditioned air is supplied to the indoor space (500) mainly from the remaining outlet openings (24*a* to 24*d*) (i.e., from the outlet openings (24*a* to 24*d*) at which the blowing wind speeds during the partial blowout mode is higher than during the full blowout mode).

The indoor unit (10) of the first aspect executes the airflow rotation. In this airflow rotation, the controller (90) controls the air current blocking mechanism (50) to switch the operation between the full blowout mode and the partial blowout mode. In other words, the airflow rotation of the indoor unit (10) includes the full blowout mode in which the conditioned air is supplied to the area relatively close to the indoor unit (10) in the indoor space (500), and the partial blowout mode in which the conditioned air is supplied to the area relatively far from the indoor unit (10) in the indoor space (500).

In a second aspect according to the first aspect, the outlet openings (24*b*, 24*d*), part of the plurality of outlet openings (24*a* to 24*d*), constitute a first opening (24X), and the outlet opening (24*a*, 24*c*), the rest of the plurality of outlet openings (24*a* to 24*d*), constitute the second opening (24Y); and the controller (90) controls the air current blocking mechanism (50) so that at least one of a first partial blowout mode of blocking flow of blowing air of the second opening (24Y) by the air current blocking mechanism (50) and increasing a blowing wind speed at the first opening (24X) or a second partial blowout mode of blocking flow of blowing air of the first opening (24X) by the air current blocking mechanism (50) and increasing a blowing wind speed at the second opening (24Y) are performed in the airflow rotation.

In a third aspect according to the first aspect, the outlet openings (24*b*, 24*d*), part of the plurality of outlet openings (24*a* to 24*d*), constitute a first opening (24X), and the outlet opening (24*a*, 24*c*), the rest of the plurality of outlet openings (24*a* to 24*d*), constitute the second opening (24Y); and the controller (90) controls the air current blocking mechanism (50) so that a first partial blowout mode of blocking flow of blowing air of the second opening (24Y) by the air current blocking mechanism (50) and increasing a blowing wind speed at the first opening (24X) and a second partial blowout mode of blocking flow of blowing air of the first opening (24X) by the air current blocking mechanism (50) and increasing a blowing wind speed at the second opening (24Y) are performed in the airflow rotation.

The indoor unit (10) of the second aspect can execute at least one of the first partial blowout mode and the second partial blowout mode, and the full blowout mode. The indoor unit (10) of the third aspect can execute the full blowout mode, the first partial blowout mode, and the second partial blowout mode.

In the full blowout mode, the conditioned air is supplied from all the outlet openings (24*a* to 24*d*) to the indoor space (500). In the first partial blowout mode, the flow of the blowing air of the second opening (24Y) is blocked by the air current blocking mechanism (50). As a result, the blowing wind speed at the first opening (24X) is higher than during the full blowout mode, and the flow of the blowing air reaches the area relatively far from the indoor unit (10)

in the indoor space (500). During the first partial blowout mode. the conditioned air is supplied to the indoor space (500) mainly from the outlet openings (24*b*. 24*d*) constituting the first opening (24X). In the second partial blowout mode, the flow of the blowing air of the first opening (24X) is blocked by the air current blocking mechanism (50). As a result, the blowing wind speed at the second opening (24Y) is higher than during the full blowout mode, and the flow of the blowing air reaches the area relatively far from the indoor unit (10) in the indoor space (500). During the second partial blowout mode, the conditioned air is supplied to the indoor space (500) mainly from the outlet openings (24*a*, 24*c*) constituting the first opening (24Y).

The indoor unit (10) of the second aspect executes the airflow rotation. In this airflow rotation, the controller (90) controls the air current blocking mechanism (50) to switch the operation between at least one of the first partial blowout mode and the second partial blowout mode and the full blowout mode.

The indoor unit (10) of the third aspect executes the airflow rotation. In this airflow rotation, the controller (90) controls the air current blocking mechanism (50) to switch the operation among the full blowout mode, the first partial blowout mode, and the second partial blowout mode.

The airflow rotation of the indoor unit (10) of each of the second and third aspects includes the full blowout mode in which the conditioned air is supplied to the area relatively close to the indoor unit (10) in the indoor space (500), and the first partial blowout mode or the second partial blowout mode in which the conditioned air is supplied to the area relatively far from the indoor unit (10) in the indoor space (500).

In a fourth aspect according to the third aspect, the controller (90) controls the air current blocking mechanism (50) so that in the airflow rotation, the full blowout mode, the first partial blowout mode. the full blowout mode, and the second partial blowout mode are sequentially repeated.

In the fourth aspect, in the airflow rotation of the indoor unit (10), the controller (90) controls the air current blocking mechanism (50) such that the full blowout mode, the first partial blowout mode, the full blowout mode, and the second partial blowout mode are sequentially repeated. In the airflow rotation of this aspect, the full blowout mode is performed between the first partial blowout mode and the second partial blowout mode.

In a fifth aspect according to the first aspect, each of the plurality of outlet openings (24*a* to 24*d*) is provided with a wind direction adjusting slat (51) for shifting a direction of blown air upward and downward; and the controller (90) controls the wind direction adjusting slat (51) so that in a heating operation in which heated conditioned air is supplied to the indoor space (500), during the full blowout mode, the flow of the blowing air of all the outlet openings (24*a* to 24*d*) is directed downward, and during the partial blowout mode, the flow of the blowing air of the outlet openings (24*a* to 24*d*) at which the blowing wind speed increases is directed horizontally.

In the fifth aspect, during the full blowout mode of the indoor unit (10), the conditioned air is blown downward from all the outlet openings (24*a* to 24*d*). Thus, during the full blowout mode, the heated conditioned air is supplied to an area near the floor surface (i.e., a foot of a person in a room). On the other hand, during the partial blowout mode of the indoor unit (10), the conditioned air is blown out in a substantially horizontal direction from part of the plurality of outlet openings (24*a* to 24*d*) provided in the indoor unit (10). In this manner, in the partial blowout mode, the flow of the blowing air having a relatively high flow speed is blown out in the substantially horizontal direction. Thus, the conditioned air can reach the area relatively far from the indoor unit (10) without discomfort that the blowing air causes by directly hitting the body of the person in the room.

In a sixth aspect according to the three or fourth aspect, each of the plurality of outlet openings (24*a* to 24*d*) is provided with a wind direction adjusting slat (51) for shifting a direction of blown air upward and downward; and the controller (90) controls the wind direction adjusting slat (51) so that in a heating operation in which heated conditioned air is supplied to the indoor space (500), during the full blowout mode, the flow of the blowing air of the first opening (24X) and the second opening (24Y) is directed downward, during the first partial blowout mode, the flow of the blowing air of the first opening (24X) is directed horizontally, and during the second partial blowout mode, the flow of the blowing air of the second opening (24Y) is directed horizontally.

In a seventh aspect according to the fourth aspect, each of the plurality of outlet openings (24*a* to 24*d*) is provided with a wind direction adjusting slat (51) for shifting a direction of blown air upward and downward; the controller (90) controls the wind direction adjusting slat (51) so that in a heating operation in which heated conditioned air is supplied to the indoor space (500), during the full blowout mode, the flow of the blowing air of the first opening (24X) and the second opening (24Y) is directed downward, during the first partial blowout mode, the flow of the blowing air of the first opening (24X) is directed horizontally, and during the second partial blowout mode, the flow of the blowing air of the second opening (24Y) is directed horizontally; and the controller (90) further controls the wind direction adjusting slat (51) so that in the airflow rotation, duration of the full blowout mode, duration of the first partial blowout mode, and duration of the second partial blowout mode are equal to each other.

In the sixth and seventh aspects, during, the full blowout mode of the indoor unit (10), the conditioned air is blown downward from the first opening (24X) and the second opening (24Y). Thus, during the full blowout mode, the heated conditioned air is supplied to an area near the floor surface (i.e., a foot of a person in a room). On the other hand, during the first partial blowout mode of the indoor unit (10), the conditioned air is blown out in a substantially horizontal direction from the first opening (24X). During the second partial blowout mode of the indoor unit (10), the conditioned air is blown out in a substantially horizontal direction from the second opening (24Y). In this manner, in the first partial blowout mode and the second partial blowout mode, the flow of the blowing air having a relatively high flow speed is blown out in the substantially horizontal direction. Thus, the conditioned air can reach the area relatively far from the indoor unit (10) without discomfort that the blowing air causes by directly hitting the body of the person in the room.

In the seventh aspect, in the airflow rotation, the duration of the first-time full blowout mode, the duration of the second-time full blowout mode, the duration of the first partial blowout mode, and the duration of the second partial blowout mode equal to each other. That is, in the indoor unit (10) of this aspect, the blowout mode is switched every time a predetermined time passes.

In an eighth aspect according to the first aspect, each of the plurality of outlet openings (24*a* to 24*d*) is provided with a wind direction adjusting slat (51) for shifting a direction of blown air upward and downward; the controller (90) controls the wind direction adjusting slat (51) so that in a cooling operation in which cooled conditioned air is supplied to the indoor space (500), during the full blowout mode, a direction of the flow of the blowing air of all the outlet openings (24*a* to 24*d*) varies and during the partial blowout mode, the flow of the blowing air of the outlet openings (24*a* to 24*d*) at which the blowing wind speed increases is directed horizontally.

In the eighth aspect, during the full blowout mode, the directions of the flow of the conditioned air blown out from all the outlet openings (24*a* to 24*d*) vary upward and downward. Thus, during the full blowout mode, the cooled conditioned air is supplied to the area relatively close to the indoor unit (10) in the indoor space (500). On the other hand, during the partial blowout mode of the indoor unit (10), the conditioned air is blown out in a substantially horizontal direction from part of the plurality of outlet openings (24*a* to 24*d*) provided in the indoor unit (10). In this manner, in the partial blowout mode, the flow of the blowing air having a relatively high flow speed is blown out in the substantially horizontal direction. Thus, the conditioned air can reach the area relatively far from the indoor unit (10) without discomfort that the blowing air causes by directly hitting the body of the person in the room.

In a ninth aspect according to the three or fourth aspect, each of the plurality of outlet openings (24*a* to 24*d*) is provided with a wind direction adjusting slat (51) for shifting a direction of blown air upward and downward; and the controller (90) controls the wind direction adjusting slat (51) so that in a cooling operation in which cooled conditioned air is supplied to the indoor space (500), during the full blowout mode, directions of the flow of the blowing air of the first opening (24X) and the second opening (24Y) vary, during the first partial blowout mode, the flow of the blowing air of the first opening (24X) is directed horizontally, and during the second partial blowout mode, the flow of the blowing air of the second opening (24Y) is directed horizontally.

In a tenth aspect according to the fourth aspect, each of the plurality of outlet openings (24*a* to 24*d*) is provided with a wind direction adjusting slat (51) for shifting a direction of blown air upward and downward; the controller (90) controls the wind direction adjusting slat (51) so that in a cooling operation in which cooled conditioned air is supplied to the indoor space (500), during the full blowout mode, directions of the flow of the blowing air of the first opening (24X) and the second opening (24Y) vary, during the first partial blowout mode, the flow of the blowing air of the first opening (24X) is directed horizontally, and during the second partial blowout mode, the flow of the blowing air of the second opening (24Y) is directed horizontally; and the controller (90) further controls the wind direction adjusting slat (51) so that in the airflow rotation, duration of the full blowout mode is longer than duration of the first partial blowout mode and duration of the second partial blowout mode.

In the ninth and tenth aspects, during the full blowout mode of the indoor unit (10), the flow direction of the conditioned air blown out from the first opening (24X) and the second opening (24 Y) varies in the vertical direction. Thus, during the full blowout mode, the cooled conditioned air is supplied to the area relatively close to the indoor unit (10) in the indoor space (500). On the other hand, during the first partial blowout mode of the indoor unit (10), the conditioned air is blown out in a substantially horizontal direction from the first opening (24X). During the second partial blowout mode of the indoor unit (10), the conditioned air is blown out in a substantially horizontal direction from the second opening (24Y). In this manner, in the first partial blowout mode and the second partial blowout mode, the blown air current having a relatively high flow speed is blown out in the substantially horizontal direction. Thus, the conditioned air can reach the area relatively far from the indoor unit (10) without discomfort that the blowing air causes by directly hitting the body of the person in the room.

In the tenth aspect, in the airflow rotation. the duration of the first-time full blowout mode and the duration of the second-time full blowout mode are longer than the duration of the first partial blowout mode, and also longer than the duration of the second partial blowout mode.

In an eleventh aspect according to any one of the first to fourth aspects, each of the plurality of outlet openings (24*a* to 24*d*) is provided with a wind direction adjusting slat (51) for shifting a direction of blown air upward and downward; and the wind direction adjusting slat (51) is configured to be able to be displaced to a position to block the flow of the blowing air of the outlet openings (24*a* to 24*d*), and also serves as the air current blocking mechanism (50).

In the eleventh aspect, the wind direction adjusting slat (51) for changing the direction of the flow of the blowing air in the vertical direction also serves as the air current blocking mechanism (50) for blocking the flow of the conditioned air. That is, the wind direction adjusting slat (51) in a predetermined position blocks the flow of the conditioned air blown out from the outlet openings (24*a* to 24*d*).

In a twelfth aspect according to the second, third, fourth, sixth, seventh, ninth, or tenth aspect, each of the first opening (24X) and the second opening (24Y) includes the plurality of and the same number of outlet openings (24*a* to 24*d*).

In the twelfth aspect, each of the first opening (24X) and the second opening (24Y) includes the plurality of outlet openings. The number of outlet openings (24*b*, 24*d*) constituting the first opening (24X) and the number of outlet openings (24*a*, 24*c*) constituting the second opening (24Y) are equal to each other.

In a thirteenth aspect according to the twelfth aspect, the indoor unit includes a casing, (20) having a rectangular lower surface; each of the main outlet openings (24*a* to 24*d*) is arranged along a respective one of four sides of the lower surface of the casing (20); the outlet opening (24*b*) and the outlet opening (24*d*) constitute the first opening (24X) where the outlet opening (24*b*) is along one of two opposite sides among the four sides of the lower side of the casing (20), and the outlet opening (24*d*) is along the other one of the two sides among the four sides of the lower side of the casing (20); and the remaining outlet openings (24*a*, 24*c*) constitute the second opening (24Y).

In a thirteenth aspect, the casing (20) includes the lower surface having the four outlet openings (24*a* to 24*d*). The outlet openings (24*b*, 24*d*), two of the four outlet openings (24*a* to 24*d*), constitute the first opening (24X), and the remaining two outlet openings (24*a*,24*c*) constitute the second opening (24Y). The outlet opening (24*b*), one of the two outlet openings (24*b*, 24*d*) constituting the first opening (24X), is arranged along the first side of the four sides of the lower surface of the casing (20), and the outlet opening (24*d*), the other one of the two outlet openings (24*b*, 24*d*) constituting the first opening (24X), is arranged along the second side opposed to the first side. The outlet opening (24*a*), one of the two outlet openings (24*a*, 24*c*) constituting the second opening (24Y), is arranged along the third side of the four sides of the lower surface of the casing (20), and the outlet opening (24*c*), the other one of the two outlet openings (24*a*, 24*c*) constituting the second opening (24Y), is arranged along the fourth side opposed to the third side.

In a fourth aspect according to the first aspect, to adjust an index temperature serving as an index of a temperature of the indoor space (500) to a set temperature, the controller (90) switches an operation state of the indoor unit between a temperature adjusting state in which a temperature of the conditioned air is adjusted and a pausing state in which adjustment of a temperature of the conditioned air is paused; and the controller (90) further controls the air current blocking mechanism (50) so that if an air conditioning load index indicating an air conditioning load in the indoor space (500) is less than or equal to a predetermined determination reference value, the indoor unit of which the operation state has been switched from the pausing state to the temperature adjusting state executes the standard blowing mode at all times, and if the air conditioning load index exceeds the determination reference value, the indoor unit of which the operation state has been switched from the pausing state to the temperature adjusting state executes the airflow rotation.

In the fourteenth aspect, to adjust the index temperature to the set temperature, the controller (90) switches the operation state of the indoor unit (10) between the temperature adjusting state and the pausing state. In other words, when the indoor unit (10) is in the pausing state and the index temperature is away from the set temperature, the controller (90) switches the operation state of the indoor unit (10) from the pausing state to the temperature adjusting state.

The controller (90) of the fourteenth aspect compares the air conditioning load index with the determination reference value when the operation state of the indoor unit (10) is switched from the pausing state to the temperature adjusting state. If the air conditioning load index is less than or equal to the predetermined determination reference value, the controller (90) controls the air current blocking mechanism (50) so that the indoor unit (10) performs the full blowout mode all the time. On the other hand, if the air conditioning load index exceeds the predetermined determination reference value, the controller (90) controls the air current blocking mechanism (50) so that the indoor unit (10) performs the airflow rotation.

In a fifteenth aspect according to the first aspect, the indoor unit includes a distance sensor (63) measuring a distance to each of wall surfaces located in a blowing direction of the conditioned air blowing out from each of the main outlet openings (24*a* to 24*d*); the controller (90) controls the air current blocking mechanism (50) so that the outlet openings (24*a* to 24*d*) of which the flow of the blowing air is blocked by the air current blocking mechanism (50) can execute mutually different plural types of the partial blowout modes; and the controller (90) further selects one or plural types of the partial blowout modes to be executed in the airflow rotation from the plural types of the partial blowout modes which are executable based on a measured value of the distance sensor (63).

The indoor unit (10) of the fifteenth aspect includes the distance sensor (63). The distance sensor (63) measures a distance to a wall surface located in a blowing direction of the conditioned air blowing out from each of the outlet openings (24*a* to 24*d*) formed in the indoor unit (10).

The indoor unit (10) of the fifteenth aspect can execute the plural types of partial blowout modes. The plural types of partial blowout modes that the indoor unit (10) can execute employ mutually different outlet openings (24*a* to 24*d*) in which the air current blocking mechanism (50) blocks the flow of the blowing air.

The controller (90) of the fifteenth aspect selects one or plural types of the partial blowout modes from the plural types of the partial blowout modes that the indoor unit (10) can execute based on a measured value of the distance sensor (63). In the airflow rotation performed by the indoor unit (10), the blowout mode is performed and switched between one or plural types of the partial blowout modes selected by the controller (90) and the full blowout mode.

Advantages of the Invention

The airflow rotation of the indoor unit (10) of the first aspect includes the full blowout mode in which the conditioned air is supplied to the area relatively close to the indoor unit (10) in the indoor space (500), and the partial blowout mode in which the conditioned air is supplied to the area relatively far from the indoor unit (10) in the indoor space (500).

The airflow rotation of the indoor unit (10) of the second aspect includes the full blowout mode in which the conditioned air is supplied to the area relatively close to the indoor unit (10) in the indoor space (500), and at least one of the first partial blowout mode and the second partial blowout mode in which the conditioned air is supplied to the area relatively far from the indoor unit (10) in the indoor space (500).

The airflow rotation of the indoor unit (10) of the third aspect includes the full blowout mode in which the conditioned air is supplied to the area relatively close to the indoor unit (10) in the indoor space (500), and the first partial blowout mode and the second partial blowout mode in which the conditioned air is supplied to the area relatively far from the indoor unit (10) in the indoor space (500).

Thus, according to the aspects of the present disclosure, the conditioned air can be supplied to the area relatively close to the indoor unit (10) and the area relatively far from the indoor unit (10) in the indoor space (500), and thus an air temperature difference among parts of the indoor space (500) can be reduced.

Here, in the partial blowout mode of the first aspect, the blowing wind speed is higher than in the full blowout mode, and the blowing air might directly hit a body of a person in the room. However, in the airflow rotation, the indoor unit (10) of the first aspect does not continue to execute the partial blowout mode, but switches the blowout mode between the partial blowout mode and the full blowout mode.

In the first partial blowout mode and the second partial blowout mode of each of the second and third aspects, the blowing wind speed is higher than in the full blowout mode, and the blowing air might directly hit a body of a person in the room. However, in the airflow rotation, the indoor unit (10) of the second aspect does not continue to execute the first partial blowout mode or the second partial blowout mode, but switches the blowout mode between at least one of the first partial blowout mode and the second partial blowout mode and the full blowout mode. In the airflow rotation, the indoor unit (10) of the third aspect does not continue to execute the first partial blowout mode or the second partial blowout mode, but switches the blowout mode among the first partial blowout mode, the second partial blowout mode, and the full blowout mode.

Thus, in the first to third aspects, the person in the room feels less uncomfortable than in the case in which the blowing air directly hits the body of the person in the room for a long time. Thus, according to the aspects of the present disclosure, the person in the room feels less uncomfortable due to the blowing air, and the air temperature difference among parts of the indoor space (500) is reduced so that the comfortability can be improved.

In the fourth aspect, in the airflow rotation of the indoor unit (10), the full blowout mode is performed between the first partial blowout mode and the second partial blowout mode. In other words, in the airflow rotation, the operation of supplying the conditioned air from one of the first opening (24X) and the second opening (24Y) to the indoor space (500) (i.e., the first partial blowout mode or the second partial blowout mode) is performed, and subsequently the full blowout mode of supplying the conditioned air from both the first opening (24X) and the second opening (24Y) to the indoor space (500) is performed. Thus, the comfort in the area relatively close to the indoor unit (10) in the indoor space (500) can be sufficiently secured.

In the fifth aspect, the indoor unit (10) blows the conditioned air downward from all the outlet openings (24*a* to 24*d*) during the full blowout mode in which the blowing wind speed is relatively low, and also blows the conditioned air in a substantially horizontal direction from part of the outlet openings (24*a* to 24*d*) formed in the indoor unit (10) during the partial blowout mode in which the blowing wind speed is relatively high.

In the sixth and seventh aspects, the indoor unit (10) blows the conditioned air downward from the first opening (24X) and the second opening (24Y) during the full blowout mode in which the blowing wind speed is relatively low, and also blows the conditioned air in a substantially horizontal direction from the first opening (24X) or the second opening (24Y) during the first partial blowout mode or the second partial blowout mode in which the blowing wind speed is relatively high.

Thus, according to the fifth, sixth, and seventh aspects, during the heating operation, it is possible to reduce the air temperature difference among parts of the indoor space (500) to improve the comfort without discomfort that the blowing air causes by directly hitting the body of the person in the room.

In the eighth aspect, the indoor unit (10) varies the direction of the flow of the blowing air of all the outlet openings (24*a* to 24*d*) during the full blowout mode in which the blowing wind speed is relatively low, and also blows the conditioned air in a substantially horizontal direction from part of the outlet openings (24*a* to 24*d*) formed in the indoor unit (10) during the partial blowout mode in which the blowing wind speed is relatively high.

In the ninth and tenth aspects, the indoor unit (10) varies the direction of the flow of the blowing air of the first opening (24X) and the second opening (24Y) during the full blowout mode in which the blowing wind speed is relatively low, and also blows the conditioned air in a substantially horizontal direction from the first opening (24X) or the second opening (24Y) during the first partial blowout mode or the second partial blowout mode in which the blowing wind speed is relatively high.

Thus, according to the eighth, ninth, and tenth aspects, during the cooling operation, it is possible to reduce the air temperature difference among parts of the indoor space (500) to improve the comfort without discomfort that the blowing air causes by directly hitting the body of the person in the room.

In the thirteenth aspect, in the indoor unit (10), the directions of the flow of the blowing air of the outlet openings (24*a* to 24*d*) are different from each other. The indoor unit (10) of this aspect can blow the conditioned air in the directions (i.e., the four directions) each orthogonal to the respective side of the lower surface of the casing (20). Thus, according to this aspect, the conditioned air can be reliably supplied to the areas around the indoor unit (10) in the indoor space (500).

If the air conditioning load exceeds a predetermined determination reference value and the operation state is switched from the pausing state to the temperature adjusting state, the controller (90) controls the air current blocking mechanism (50) to execute the airflow ration.

In the airflow rotation of the indoor unit (10), the partial blowout mode is executed. Compared with the full blowout mode, this partial blowout mode enables the conditioned air to be supplied to an area relatively far from the indoor unit (10) in the indoor space (500).

Thus, according to the fourteenth aspect, if the air conditioning load exceeds a predetermined determination reference value (i.e., the air conditioning load in the indoor space (500) is relatively large) and the operation state is switched from the pausing state to the temperature adjusting state, the indoor unit (10) performs the airflow rotation such that the index temperature serving as an index of an temperature in the indoor space (500) can be quickly adjusted toward a set temperature, and the comfort in the indoor space (500) can be improved.

Here, in the partial blowout mode, when the air flow formed by the conditioned air blown out from the outlet openings (24*a* to 24*d*) and having a relatively high speed reaches a wall, the conditioned air flowing from the wall along the floor might causes the air flow covering the whole of the indoor space (500). However, if the distance from the indoor unit (10) to the wall is long, the flow of the blowing air of the outlet openings (24*a* to 24*d*) during the partial blowout mode does not reach the wall, and the air flow covering the whole of the indoor space (500) cannot be formed. Thus, when the air flow covering the whole of the indoor space (500) is used to reduce a temperature variation in the indoor space (500), it is necessary to increase a blowing wind speed at the outlet openings (24*a* to 24*d*) blowing the conditioned air toward the wall located in a proper distance from the indoor unit (10), whereas it is unnecessary to increase a blowing wind speed at the outlet openings (24*a* to 24*d*) blowing the conditioned air toward the wall located far from the indoor unit (10).

In contrast, the controller (90) of the fifteenth aspect selects one or plural types of the partial blowout modes to be executed in the airflow rotation from the plural types of the partial blowout modes that the indoor unit (10) can execute based on a measured value of the distance sensor (63). Thus, according to this aspect, it is possible to automatically select an appropriate partial blowout mode that can contribute to an improvement in the comfort in the room based on a measured value of the distance sensor (63), and thus the convenience of the user of the air conditioning device can be increased.

BRIEF DESCRIPTION OF THE DRAWINGS

FIG. 10A is a plan view of an indoor space, and shows a temperature distribution in a room in a state in which a conventional indoor unit is performing a heating operation.

FIG. 11A is a plan view of an indoor space, and shows a temperature distribution in a room in a state in which a conventional indoor unit is performing a cooling operation.

DETAILED DESCRIPTION OF THE INVENTION

Embodiments of the present invention will be described in detail with reference to the drawings. Note that the following embodiments and variations are merely beneficial examples in nature, and are not intended to limit the scope, applications, or use of the invention.

—Configuration of Indoor Unit—

Figure 1:
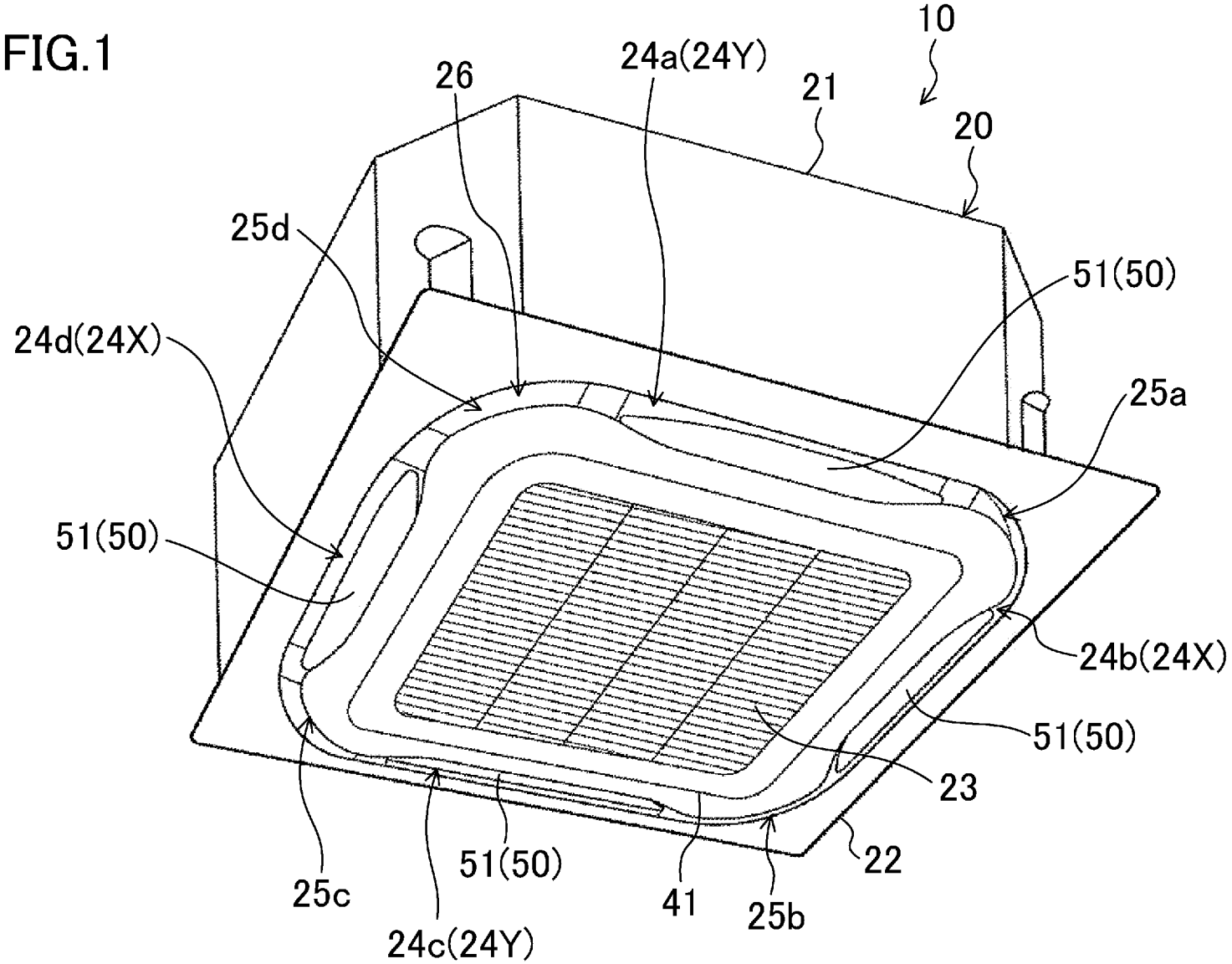
FIG. 1 is a perspective view of an indoor unit of an embodiment as viewed diagonally from below.

As illustrated in FIG. 1, an indoor unit (10) of this embodiment is configured as a so-called ceiling embedded type. This indoor unit (10) and an outdoor unit (not shown) constitute an air conditioner. In the air conditioner, the indoor unit (10) and the outdoor unit are connected through an interconnecting pipe to form a refrigerant circuit in which a refrigerant circulates to conduct a refrigeration cycle.

Figure 2:
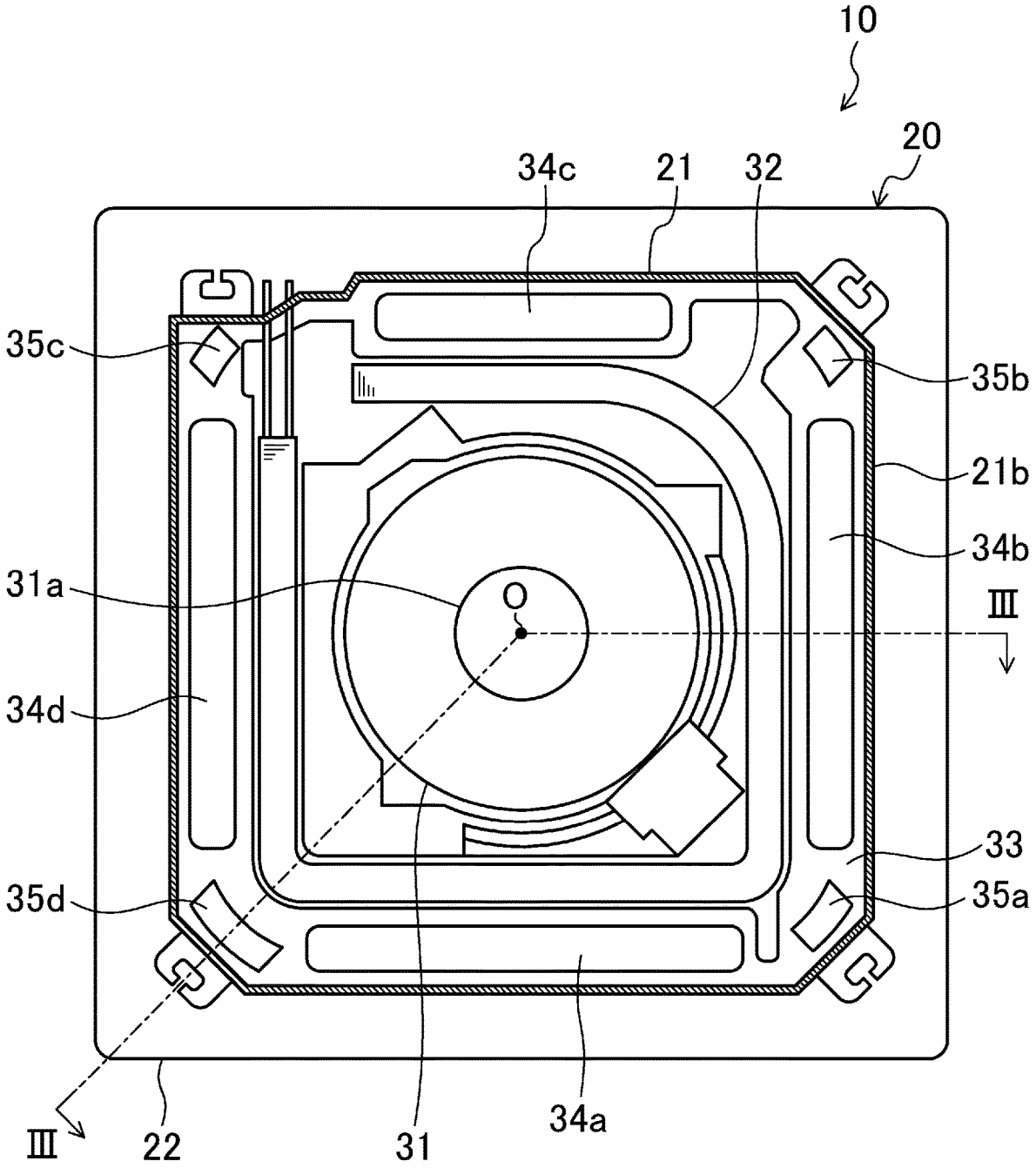
FIG. 2 is a schematic plan view of the indoor unit without a top plate of a casing body.
Figure 3:
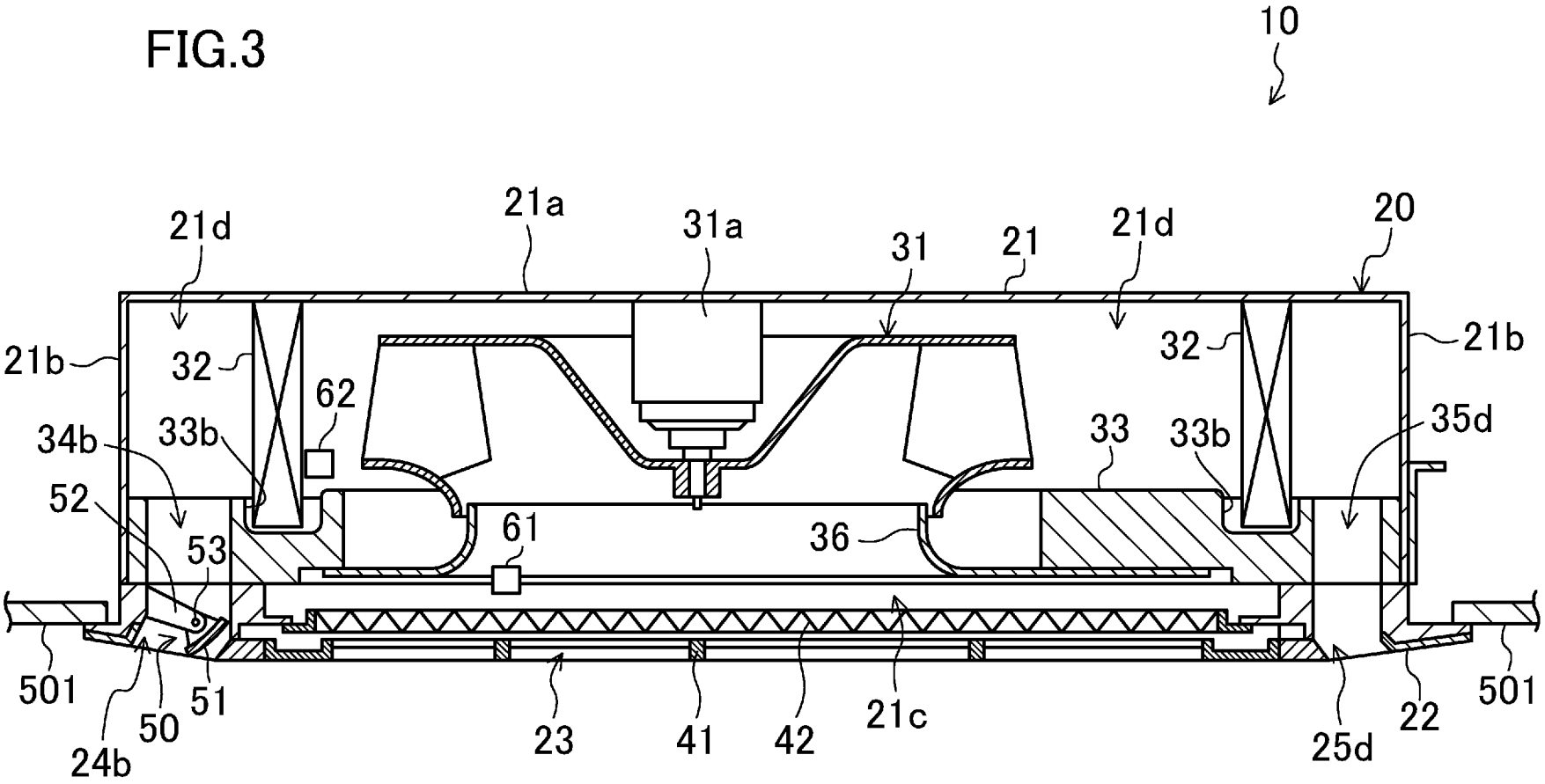
FIG. 3 is a schematic cross-sectional view of the indoor unit taken along line III-O-III in FIG. 2.

As illustrated in FIGS. 2 and 3, the indoor unit (10) includes a casing (20), an indoor fan (31), an indoor heat exchanger (32), a drain pan (33), a bell mouth (36), and a controller (90). The indoor unit (10) is provided with a suction temperature sensor (61) and a heat exchanger temperature sensor (62).

<Casing>

The casing (20) is provided on a ceiling (501) of an indoor space (500). The casing (20) includes a casing body (21) and a decorative panel (22). This casing (20) houses the indoor fan (31), the indoor heat exchanger (32), the drain pan (33), and the bell mouth (36).

The casing body (21) is inserted into and arranged in an opening formed in the ceiling (501) of the indoor space (500). The casing body (21) has a shape of an generally rectangular parallelepiped box with a lower surface opening downward. This casing body (21) includes a generally flat plate top panel (21*a*), and a side panel (21*b*) extending downward from a peripheral section of a top panel (21*a*).

<Indoor Fan>

As illustrated FIG. 3, the indoor fan (31) is a centrifugal blower suctioning air from therebelow and blowing the air outwardly in the radial direction. The indoor fan (31) is arranged in the center of the inside of the casing body (21). The indoor fan (31) is driven by an indoor fan motor (31*a*). The indoor fan motor (31*a*) is fixed on a center section of the top panel (21*a*).

<Bell Mouth>

The bell mouth (36) is arranged below the indoor fan (31). This bell mouth (36) is a member for guiding the air flown into the casing (20) to the indoor fan (31). The bell mouth (36) and the drain pan (33) partition the internal space of the casing (20) into a primary space (21*c*) located in a suction side of the indoor fan (31) and a secondary space (21*d*) located in a blowing side of the indoor fan (31).

<Indoor Heat Exchanger>

The indoor heat exchanger (32) is a so-called cross-fin type fin-tube heat exchanger. As illustrated in FIG. 2, the indoor heat exchanger (32) is formed in a surrounding shape in plan view, and is arranged to surround the periphery of the indoor fan (31). This is the indoor heat exchanger (32) is arranged in the secondary space (21*d*). The indoor heat exchanger (32) exchanges heat between the air passing from the inside toward the outside and a refrigerant of a refrigerant circuit.

<Drain Pan>

The drain pan (33) is a so-called styrofoam member. As illustrated in FIG. 3, the drain pan (33) is arranged to block a lower end of the casing body (21). The drain pan (33) includes an upper surface on which a water reception groove (33*b*) is formed along a lower end of the indoor heat exchanger (32). A lower end section of the indoor heat exchanger (32) is inserted into the water reception groove (33*b*). The water reception groove (33*b*) receives drain water generated in the indoor heat exchanger (32).

As illustrated in FIG. 2, the drain pan (33) includes four main blowout passages (34*a* to 34*d*) and four subsidiary blowout passages (35*a* to 35*d*). The main blowout passages (34*a* to 34*d*) and the subsidiary blowout passages (35*a* to 35*d*) are passages through which the air having passed through the indoor heat exchanger (32) flows, and penetrates the drain pan (33) in the vertical direction. The main blowout passages (34*a* to 34*d*) are rectangular through holes having a slender cross section. Each of the main blowout passages (34*a* to 34*d*) is arranged along a respective one of four sides of the casing body (21). The subsidiary blowout passages (35*a* to 35*d*) are rectangular through holes having a slightly curved cross section. Each of the subsidiary blowout passages (35*a* to 35*d*) is arranged at a respective one of four corners of the casing body (21). That is, the main blowout passages (34*a* to 34*d*) and the subsidiary blowout passages (35*a* to 35*d*) are alternately arranged along the peripheral edge of the drain pan (33).

<Decorative Panel>

The decorative panel (22) is a resinous member formed into a rectangular thick plate shape. The decorative panel (22) includes a lower section formed into a square shape slightly larger than the top plate (21*a*) of the casing body (21). The decorative panel (22) is arranged to cover the lower surface of the casing body (21). The lower surface of the decorative panel (22) serves as the lower surface of the casing (20) and is exposed to the indoor space (500).

Figure 4:
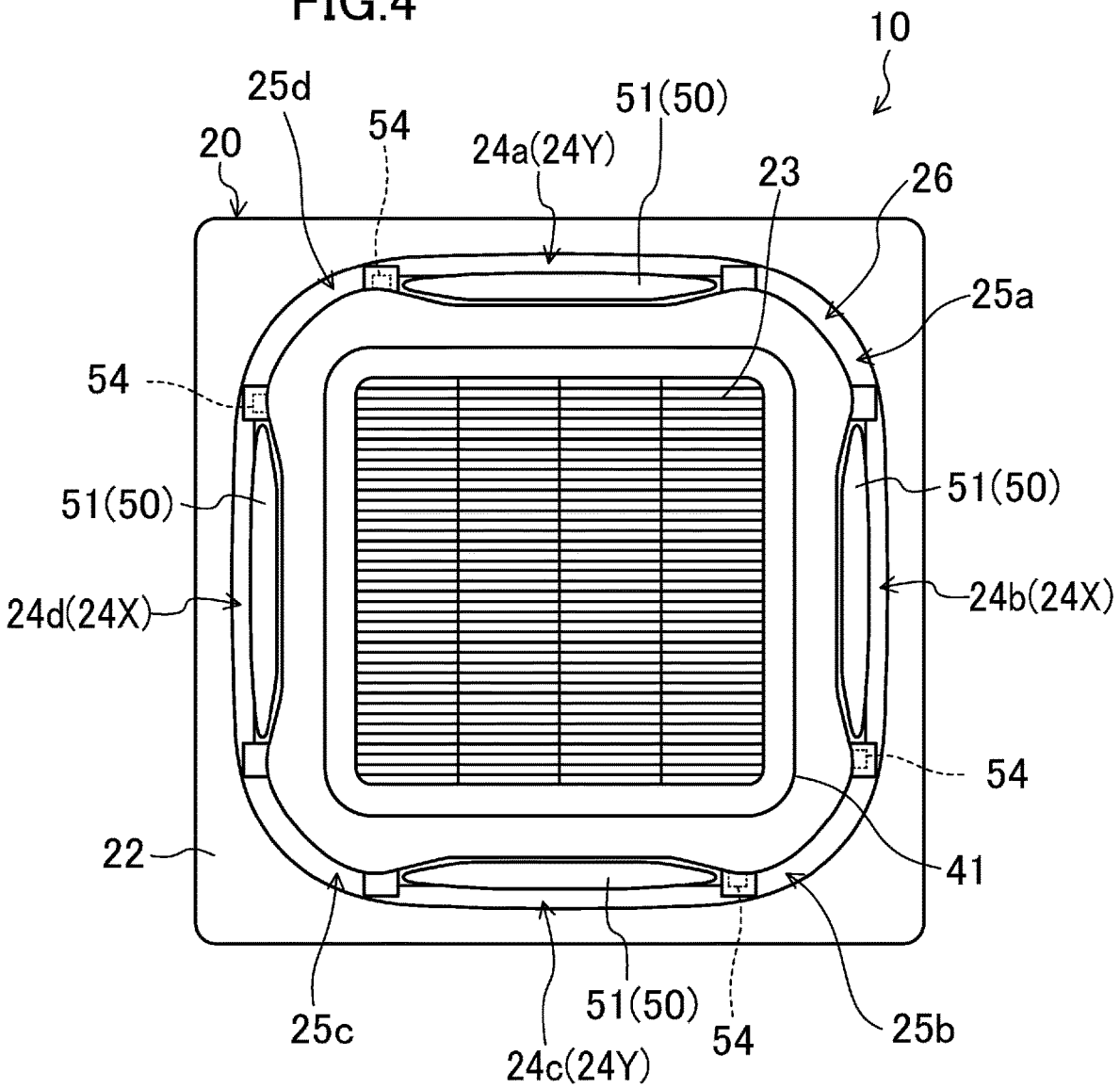
FIG. 4 is a schematic bottom view of the indoor unit.

As illustrated in FIGS. 3 and 4, the decorative panel (22) includes a central section having a square inlet (23). The inlet (23) passes vertically through the decorative panel (22) and communicates with the primary space (21*c*) in the casing (20). The air sucked into the casing (20) flows into the primary space (21*c*) through the inlet (23). The inlet (23) is provided with a grid-like suction grill (41). A suction filter (42) is arranged above the suction grill (41).

The decorative panel (22) includes a substantially rectangular annular air outlet (26) surrounding the inlet (23). As illustrated in FIG. 4, the air outlet (26) is divided into four main outlet openings (24*a* to 24*d*) and four subsidiary outlet openings (25*a* to 25*d*).

The main outlet openings (24*a* to 24*d*) are slender openings corresponding to the cross-sectional shape of the main blowout passages (34*a* to 34*d*). Each of the main outlet openings (24*a* to 24*d*) is arranged along a respective one of the four sides of the decorative panel (22). In the indoor unit (10) of the embodiment, the second main outlet opening (24*b*) and the fourth main outlet opening (24*d*) arranged along two sides, opposite to each other, of the decorative panel (22) constitute a first opening (24X). The first main outlet opening (24*a*) and the third main outlet opening (24*c*) constitute a second opening (24Y).

The main outlet openings (24*a* to 24*d*) of the decorative panel (22) correspond to the main blowout passages (34*a* to 34*d*) of the drain pan (33), respectively. Each of the main outlet openings (24*a* to 24*d*) communicates with a respective one of the main blowout passages (34*a* to 34*d*). In other words, the first main outlet opening (24*a*) communicates with the first main blowout passage (34*a*), the second main outlet opening (24*b*) communicates with the second main blowout passage (34*b*), the third main outlet opening (24*c*) communicates with the main blowout passage (34*c*), and the fourth main outlet opening (24*d*) communicates with the fourth main blowout passage (34*d*).

The subsidiary outlet openings (25*a* to 25*d*) are ¼ arc shaped openings. Each of the subsidiary outlet openings (25*a* to 25*d*) is arranged at a respective one of the four corners of the decorative panel (22). The subsidiary outlet openings (25*a* to 25*d*) of the decorative panel (22) correspond to the subsidiary blowout passages (35*a* to 35*d*) of the drain pan (33), respectively. Each of the subsidiary outlet openings (25*a* to 25*d*) communicates with a respective one of the subsidiary blowout passages (35*a* to 35*d*). In other words, the first subsidiary outlet opening (25*a*) communicates with the first subsidiary blowout passage (35*a*), the second subsidiary outlet opening (25*b*) communicates with the second subsidiary blowout passage (35*b*), the third subsidiary outlet opening (25*c*) communicates with the subsidiary blowout passage (35*c*), and the fourth subsidiary outlet opening (25*d*) communicates with the fourth subsidiary blowout passage (35*d*).

<Airflow Direction Adjusting Blade>

As illustrated in FIG. 4, each of the main outlet openings (24*a* to 24*d*) is provided with a wind direction adjusting slat (51). The wind direction adjusting slat (51) is a member for adjusting the direction of flow of the blowing air (i.e., the direction of flow of the conditioned air blown out from the main outlet openings (24*a* to 24*d*)).

The wind direction adjusting slat (51) changes the direction of flow of the blowing air in the vertical direction. In other words, the wind direction adjusting slat (51) changes the direction of flow of the blowing air to change the angle formed by the direction of flow of the blowing air and the horizontal direction.

The wind direction adjusting slat (51) is formed in a slender plate shape extending from one end to the other end of the longitudinal direction of the main outlet openings (24*a* to 24*d*) of the decorative panel (22). As illustrated in FIG. 3, the wind direction adjusting slat (51) is supported by the support member (52) to be rotatable around a central axis (53) extending in the longitudinal direction of the wind direction adjusting slat (51). The wind direction adjusting slat (51) is curved such that the cross section thereof (the cross section orthogonal to the longitudinal direction) has a raised shape in a direction away from the central axis (53) of the swing motion.

As illustrated in FIG. 4, the wind direction adjusting slats (51) is coupled with a drive motor (54). The wind direction adjusting slat (51) is driven by the drive motor (54) to rotationally move around the central axis (53) within a predetermined angular range. As will be described in detail later, the wind direction adjusting slat (51) can be displaced to an airflow block position to block flow of the air passing through the main outlet openings (24*a* to 24*d*). The wind direction adjusting slat (51) also serves as an air current blocking mechanism (50) that blocks flow of the blowing air of the main outlet openings (24*a* to 24*d*).

<Sensor>

The suction temperature sensor (61) is arranged near the entrance of the bell mouth (36) in the primary space (21*c*). The suction temperature sensor (61) measures a temperature of the air flowing through the primary space (21*c*) (i.e., a temperature of the air sucked from the indoor space (500) into the indoor unit (10) through the inlet (23)). On the other hand, the heat exchanger temperature sensor (62) is attached to the indoor heat exchanger (32). The heat exchanger temperature sensor (62) measures a temperature of a surface of the indoor heat exchanger (32). A measured value of the suction temperature sensor (61) and a measured value of the heat exchanger temperature sensor (62) are input to the controller (90).

<Controller>

The controller (90) is configured to control operation of the indoor unit (10). Although not shown, the controller (90) is provided with, e.g., a CPU for computations, a memory for storing data, a dip switch used by an installation operator or a maintenance operator to set operation of the controller (90).

Figure 5:
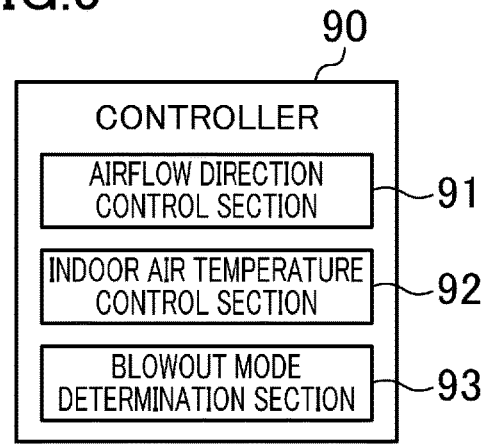
FIG. 5 is a block diagram showing a configuration of a controller.

As illustrated in FIG. 5, the controller (90) includes an airflow direction control section (91), an indoor temperature control unit (92), and a blowing mode determination section (93). The controller (90) also controls a rotational speed of the indoor fan (31).

The airflow direction control section (91) is configured to control a position of the wind direction adjusting slat (51) by operating the drive motor (54). The controller (90) is configured to control a position of each of the four wind direction adjusting slats (51) individually. The airflow direction control section (91) is configured to control a position of the wind direction control blade (51) so that the indoor unit (10) can execute a full blowout mode, a first partial blowout mode, and a second partial blowout mode described later. Further, the airflow direction control section (91) is configured to control a position of the wind direction adjusting slat (51) provided in each of the main outlet openings (24*a* to 24*d*) so that the indoor unit (10) selectively performs a standard blowing mode and an airflow rotation.

In the standard blowing mode, the indoor unit (10) performs only the full blowout mode. In other words, the standard blowing mode is an operation mode in which the indoor unit (10) always performs the full blowout mode. On the other hand, the indoor unit (10) can execute, as airflow rotation, a first blowing mode, a second blowing mode, and a third blowing mode described later. The blowing mode of the indoor unit (10) as the airflow rotation is set by an installation operator or a maintenance operator of the indoor unit (10) by operating the dip switch of the controller (90).

The indoor temperature control unit (92) performs a temperature control operation. In this temperature control operation, in order to adjust an index temperature serving as an index of a temperature of the indoor space (500) to a set temperature, the operation state of the indoor unit (10) is switched between a temperature adjusting state in which a temperature of the conditioned air is adjusted and a pausing state in which the adjustment of a temperature of the conditioned air is paused. The temperature control operation will be described in detail later.

The blowing mode determination section (93) performs a mode determining operation. This mode determining operation is an operation of determining which of the standard blowing mode or the airflow rotation is to be executed by the indoor unit (10) of which the operating state is switched from the pausing state to the temperature adjusting state by the temperature control operation. The mode determining operation will be described in detail later.

Note that the dip switch that an installation operator etc. of the indoor unit (10) uses to set the blowing mode executed as the airflow rotation may be provided in a place other than the controller (90) of the indoor unit (10). This dip switch may be provided in, for example, a controller of the outdoor unit of the air conditioner or a remote controller of the air conditioner.

The way in which the installation operator etc. of the indoor unit (10) sets the blowing mode executed as the airflow rotation is not limited to the dip switch. For example, the installation operator etc. of the indoor unit (10) may operate a remote controller to set the blowing mode executed as the airflow rotation. In that case, if the blowing modes that the indoor unit (10) can execute are displayed on a display screen of the remote controller, the installation can be easily conducted.

—Cooling Operation and Heating Operation of Indoor Unit—

The indoor unit (10) selectively performs a cooling operation for cooling the indoor space (500) and a heating operation for heating the indoor space (500).

The indoor unit (10) during the cooling operation is switched between the temperature adjusting state in which the indoor heat exchanger (32) functions as an evaporator and the air is cooled in the indoor heat exchanger (32) and the pausing state in which a supply of a refrigerant to the indoor heat exchanger (32) is paused and a cooling operation of the air in the indoor heat exchanger (32) is paused. Note that, in the indoor unit (10) during the cooling operation, the indoor fan (31) is operated in both the temperature adjusting state and the pausing state.

The indoor unit (10) during the heating operation is switched between the temperature adjusting state in which the indoor heat exchanger (32) functions as a condenser and the air is heated in the indoor heat exchanger (32) and the pausing state in which a supply of a refrigerant to the indoor heat exchanger (32) is paused and a heating operation of the air in the indoor heat exchanger (32) is stopped. Note that, in the indoor unit (10) during the heating operation, the indoor fan (31) is operated in both the temperature adjusting state and the pausing state.

—Air Flow in Indoor Unit—

When the indoor unit (10) operates, the indoor fan (31) rotates. When the indoor fan (31) rotates, the indoor air in the indoor space (500) flows into the primary space (21*c*) in the casing (20) through the inlet (23). The air flowing into the primary space (21*c*) is sucked into the indoor fan (31) and blown out to the secondary space (21*d*).

The air flowing into the secondary space (21*d*) is cooled or heated when passing through the indoor heat exchanger (32), and then is divided and flows into the four main blowout passages (34*a* to 34*d*) and the four subsidiary blowout passages (35 *a* to 35*d*). The air flowing into the main blowout passages (34*a* to 34*d*) is blown out to the indoor space (500) through the main outlet openings (24*a* to 24*d*). The air flowing into the subsidiary blowout passages (35*a* to 35*d*) is blown out to the indoor space (500) through the subsidiary outlet openings (25*a* to 25*d*).

—Operation of Airflow Direction Adjusting Blade—

As described above, the wind direction adjusting slat (51) rotationally moves around the central axis (53) to change the direction of flow the blowing air. The wind direction adjusting slat (51) is movable between a horizontally blowing position shown in FIG. 6 and a downward blowing position shown in FIG. 7. Further, the wind direction adjusting slat (51) can rotationally move from the downward blowing position shown in FIG. 7 to an airflow block position shown in FIG. 8.

Figure 6:
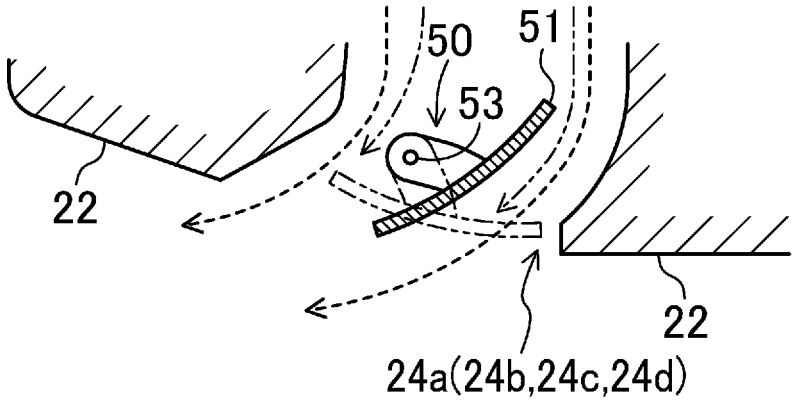
FIG. 6 is a cross-sectional view of a main part of a decorative panel, and illustrates a wind direction adjusting slat in a horizontally blowing position.

When the wind direction adjusting slat (51) is in the horizontally blowing position shown in FIG. 6, the direction of flow of the air flowing downward through the main blowing paths (34*a* to 34*d*) is changed in the horizontal direction, and the flow of the blowing air of the main outlet openings (24*a* to 24*d*) is directed horizontally. In this case, the direction of flow of the blowing air of the main outlet openings (24*a* to 24*d*) (i.e., the direction of flow of the conditioned air blown out from the main outlet openings (24*a* to 24*d*)) is set to, for example, about 20° with respect to the horizontal direction. In this case, strictly speaking, the direction of flow of the blowing air is slightly downward from the horizontal direction, but it can be said that the direction of flow of the air is substantially horizontal.

Figure 7:
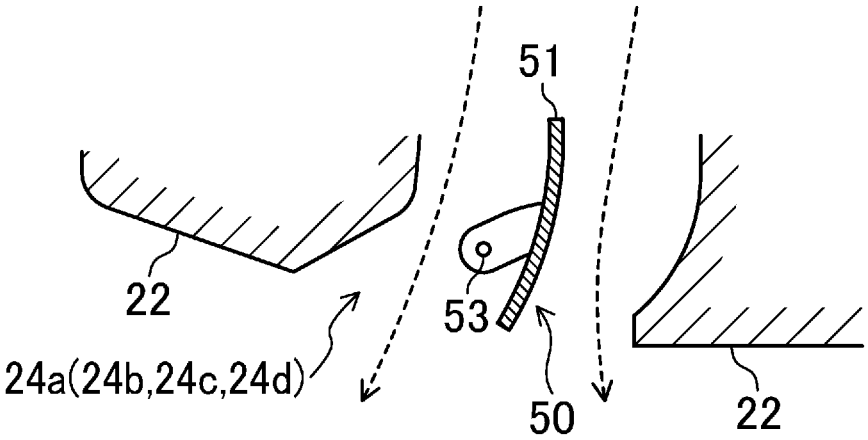
FIG. 7 is a cross-sectional view of the main part of the decorative panel, and illustrates the wind direction adjusting slat in a downward blowing position.

When the wind direction adjusting slat (51) is in the downward blowing position shown in FIG. 7, the direction of flow of the air flowing downward through the main blowout passages (34*a* to 34*d*) is substantially maintained, and the flow of the blowing air of the main blowing the opening (24*a* to 24*d*) is directed downward. In this case, strictly speaking, the flow of the blowing air is directed obliquely downward, i.e., slightly inclined from directly below in a direction away from the inlet (23).

Figure 8:
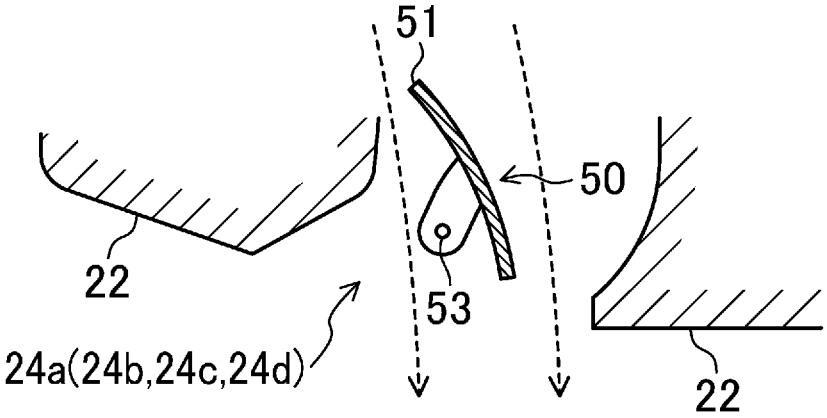
FIG. 8 is a cross-sectional view of the main part of the decorative panel, and illustrates the wind direction adjusting slat in an airflow block position.

When the wind direction adjusting slat (51) is in the airflow block position shown in FIG. 8, most of the main outlet openings (24*a* to 24*d*) are blocked by the wind direction adjusting slat (51), and the direction of flow of the air flowing downward through the main blowout passages (34*a* to 34*d*) is changed toward the inlet (23). In this case, pressure loss of the air passing through the main outlet openings (24*a* to 24*d*) increases, and thus the flow rate of the conditioned air passing through the main outlet openings (24*a* to 24*d*) decreases. The conditioned air is blown out from the main outlet openings (24*a* to 24*d*) toward the inlet (23). Thus, the conditioned air blown out from the main outlet openings (24*a* to 24*d*) is immediately sucked into the inlet (23). That is, the conditioned air is substantially not supplied to the indoor space (500) from the main outlet openings (24*a* to 24*d*) where the wind direction adjusting slat (51) is in the airflow block position.

—Operation of Airflow Direction Control Section—

The airflow direction control section (91) changes a position of the wind direction adjusting slat (51) provided in each of the main outlet openings (24*a* to 24*d*) so that the indoor unit (10) performs the airflow rotation. During this airflow rotation, the controller (90) keeps the rotational speed of the indoor fan (31) substantially at the maximum value.

First, the operation of the airflow direction control section (91) where the indoor unit (10) performs the first blowing mode as the airflow rotation will be described in detail. Then, the operation of the airflow direction control section (91) where the indoor unit (10) performs each of the second and third blowing modes as the airflow rotation will be described.

<First Blowing Mode>

Figure 9:
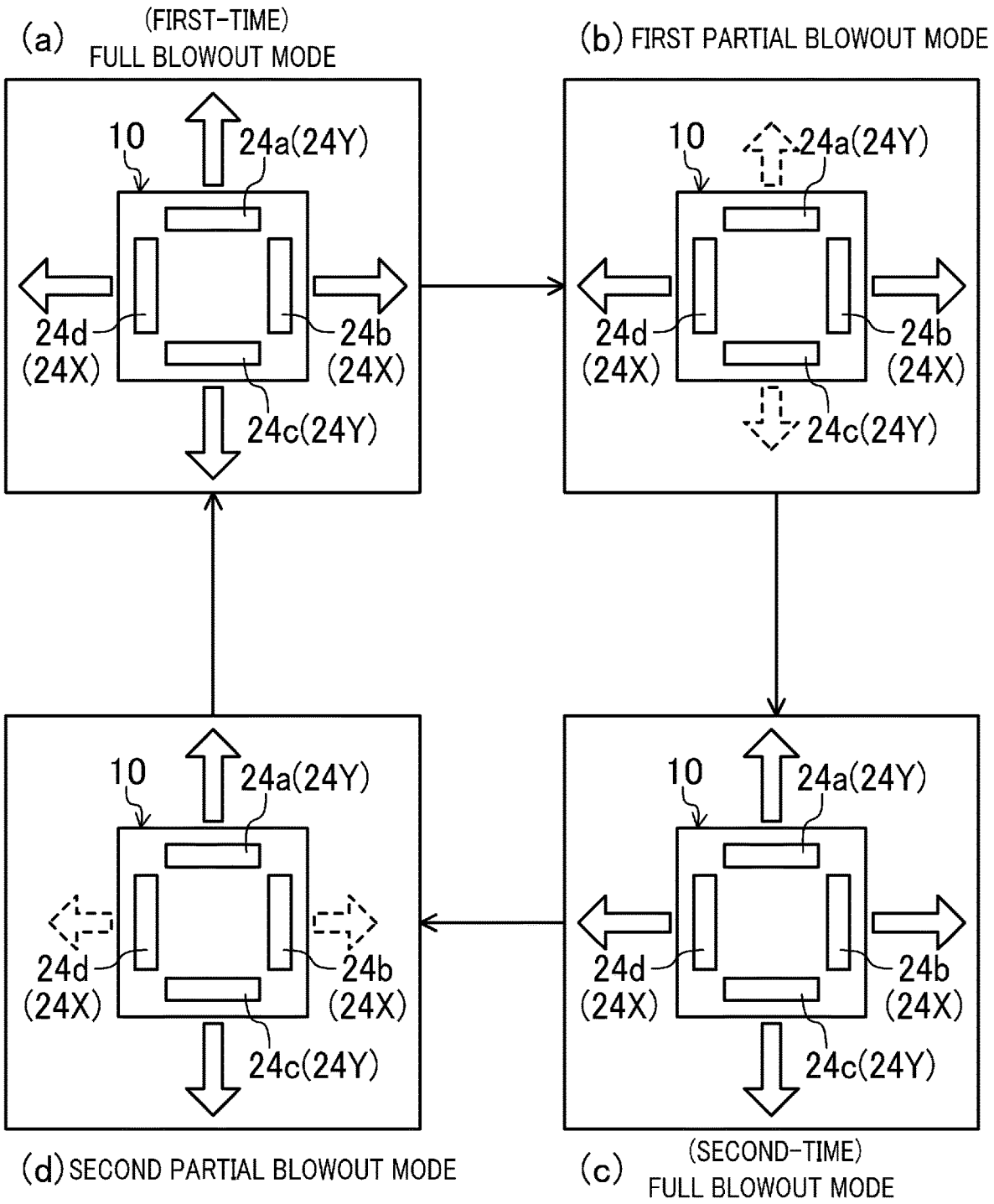
FIG. 9 is an explanatory view showing one cycle of a first blowing mode performed by the indoor unit, and schematically shows a lower surface of the indoor unit in each operation.

As illustrated in FIG. 9, in one cycle of the first blowing mode performed as the airflow rotation, the first-time full blowout mode, the first partial blowout mode, the second-time full blowout mode, and the second partial blowout mode are sequentially performed. That is, in one cycle of the first blowing mode, two full blowout modes, one first partial blowout mode, and one second partial blowout mode are performed.

<First Blowing Mode (Airflow Rotation) in Heating Operation>

In the full blowout mode during the heating operation, the airflow direction control section (91) sets the wind direction adjusting slats (51) of all the main outlet openings (24*a* to 24*d*) to the downward blowing positions. Thus, in the full blowout mode during the heating operation, the conditioned air is blown downward from the four main outlet openings (24*a* to 24*d*).

In the first partial blowout mode during the heating operation, the airflow direction control section (91) sets the wind direction adjusting slats (51) of the two main outlet openings (24*b*, 24*d*) constituting the first opening (24X) to the horizontally blowing positions, and sets the wind direction adjusting slats (51) of the two main outlet openings (24*a*, 24*c*) constituting the second opening (24Y) to the airflow block positions. Thus, the conditioned air is blown out from the second main outlet opening (24*b*) and the fourth main outlet opening (24*d*) to the indoor space (500), and substantially not blown out from the first main outlet opening (24*a*) and the third main outlet opening (24*c*) to the indoor space (500). The blowing wind speeds at the second main outlet opening (24*b*) and the fourth main outlet opening (24*d*) are higher than blowing wind speeds in the full blowout mode. That is, in this first partial blowout mode, the conditioned air is blown from the second main outlet opening (24*b*) and the fourth main outlet opening (24*d*) substantially in a horizontal direction at a higher flow speed than in the full blowout mode.

In the second partial blowout mode during the heating operation, the airflow direction control section (91) sets the wind direction adjusting slats (51) of the two main outlet openings (24*a*,24*c*) constituting the second opening (24Y) to the horizontally blowing positions, and sets the wind direction adjusting slats (51) of the two main outlet openings (24*b*,24*d*) constituting the first opening (24X) to the airflow block positions. Thus, the conditioned air is blown out from the first main outlet opening (24*a*) and the third main outlet opening (24*c*) to the indoor space (500), and substantially not blown out from the second main outlet opening (24*b*) and the fourth main outlet opening (24*d*) to the indoor space (500). The blowing wind speeds at the first main outlet opening (24*a*) and the third main outlet opening (24*c*) are higher than blowing wind speeds in the full blowout mode. That is, in this first partial blowout mode, the conditioned air is blown from the second main outlet opening (24*b*) and the fourth main outlet opening (24*d*) substantially in a horizontal direction at a higher flow speed than in the full blowout mode.

Note that, in any of the full blowout mode, the first partial blowout mode, and the second partial blowout mode, the subsidiary outlet openings (25*a* to 25*d*) blows out the conditioned air.

As illustrated in FIG. 9, in one cycle of the first blowing performed during the heating operation, the first-time full blowout mode, the first partial blowout mode, the second-time full blowout mode, and the second partial blowout mode are sequentially performed. In one cycle of the first blowing mode during the heating operation, the duration of the first-time full blowout mode, the duration of the first partial blowout mode, the duration of the second-time full blowout mode, and the duration of the second partial blowout mode are set equal to each other (e.g., 120 seconds).

Note that, in one cycle of the first blowing mode during the heating operation, the duration of each of the first and second-time full blowout modes may be set longer than each of the duration of the first partial blowout mode and the duration of the second partial blowout mode.

<Temperature Distribution of Indoor Space in Heating Operation>

The temperature distribution in the indoor space (500) during the heating operation will be described with reference to FIGS. 10A and 10B.

Figure 10B:
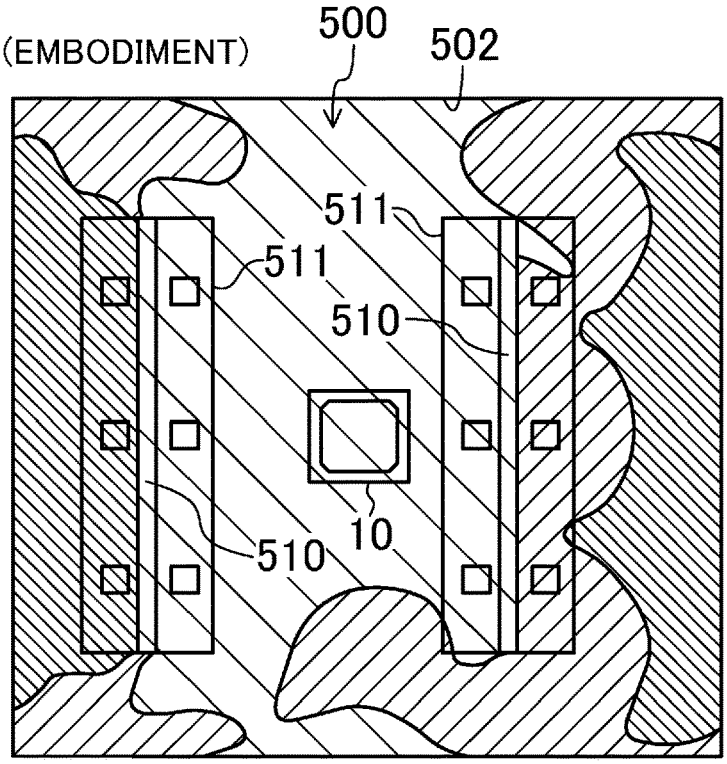
FIG. 10B is a plan view of an indoor space, and shows the temperature distribution in a room in a state in which the indoor unit of the embodiment is performing airflow rotation during a heating operation.

FIGS. 10A and 10B show simulation results of the temperature distribution of the indoor space (500) during the heating operation of the indoor unit (10). FIGS. 10A and 10B show temperatures at a position in which 20 minutes have passed after the indoor unit (10) started the heating operation and which is away by 60 cm from a floor surface of the indoor space (500). In FIGS. 10A and 10B, a region having a higher hatching density has a higher air temperature.

Note that, in the room simulated, the floor surface is roughly squared, and two elongated desks (511) each having a partition (510) at the center are arranged in parallel. The indoor unit (10) is arranged approximately at the center of the ceiling of the indoor space (500).

First, the temperature distribution in the indoor space (500) in which a conventional indoor unit (610) is installed will be described with reference to FIG. 10A.

During the heating operation, in the conventional indoor unit (610), the wind direction adjusting slats (51) of all the main outlet openings (24*a* to 24*d*) are set toward the downward blowing position. Then, the conventional indoor unit (610) blows the air heated when passing through the indoor heat exchanger (32), from all the main outlet openings (24*a* to 24*d*) substantially toward the floor surface.

As illustrated in FIG. 10A, in the indoor space (500), a central region located below the indoor unit (610) has an extremely high air temperature. This is presumably because the warm conditioned air blown downward from the indoor unit (610) stays in the central region of the interior space (500) sandwiched between the two partitions (510).

On the other hand, in the indoor space (500), a peripheral region apart from the indoor unit (610) does not have a sufficiently increased air temperature. This is presumably because the warm conditioned air blown downward from the indoor unit (610) cannot reach an area close to a wall (502) over the partition (510).

Next, the temperature distribution in the indoor space (500) in which the indoor unit (10) of the embodiment is installed will be described with reference to FIG. 10B.

During the heating operation, the indoor unit (10) of the embodiment performing the first blowing mode repeatedly performs the first-time full blowout mode, the first partial blowout mode, the second-time full blowout mode, and the second partial blowout mode in order.

In the full blowout mode, the warm conditioned air blown downward from the indoor unit (10) is supplied to the central region of the indoor space (500) sandwiched between the two partitions (510). Thus, in the indoor space (500), the central region located below the indoor unit (10) has an increased air temperature. Note that the full blowout mode is performed intermittently, and thus the central region of the indoor space (500) does not have an excessively increased temperature.

On the other hand, in the first partial blowout mode and the second partial blowout mode, the warm conditioned air blown out from the indoor unit (10) is blown out substantially in a horizontal direction at a higher flow speed than in the full blowout mode. Thus, in the first partial blowout mode and the second partial blowout mode, the warm conditioned air blown out from the indoor unit (10) flows above the partition (510) and then reaches the wall (502) of the indoor space (500). Thus, in the indoor space (500), the peripheral region apart from the indoor unit (10) also has an increased air temperature.

In the first partial blowout mode and the second partial blowout mode, the warm conditioned air blown out from the indoor unit (10) reaches the wall (502) of the indoor space (500) and then flows downward along the wall (502). Thus, the wall (502) of the indoor space (500) is warmed by the conditioned air, and consequently, the temperature of the wall (502) of the indoor space (500) increases. Thus, the conditioned air warms the wall (502) such that the peripheral region in the indoor space (500) has an air temperature prevented from decreasing.

The warm conditioned air blown out from the indoor unit (10) and reaching the wall (502) of the indoor space (500) flows along the floor from the wall (502), and thus an airflow is formed to cover the whole of the indoor space (500). Such an airflow is also formed such that the warm conditioned air spreads through the whole of the indoor space (500). Thus, an air temperature difference between the central section and the peripheral section of the indoor space (500) is reduced.

In this manner, when the indoor unit (10) of the embodiment performs the first blowing mode (i.e., the airflow rotation) during the heating operation, the air temperature difference between the central section and the peripheral section of the space (500) is more significantly decreased than when the conventional indoor unit (610) performs the heating operation.

<First Blowing Mode (Airflow Rotation) in Cooling Operation>

In the full blowout mode during the cooling operation, the airflow direction control section (91) makes the wind direction adjusting slats (51) of all the main outlet openings (24*a* to 24*d*) move between the horizontally blowing position and the downward blowing position. Thus, in the full blowout mode during the cooling operation, the conditioned air is blown out from the four main outlet openings (24*a* to 24*d*), and the direction of flow of the blown air of the main outlet openings (24*a* to 24*d*) varies. Note that. in the full blowout mode during the cooling operation, the lower limit of the moving range of the wind direction adjusting slat (51) may be set to a position higher than the downward blowing position (i.e. a position closer to the horizontally blowing position).

In the first partial blowout mode during the cooling operation, similarly to the first partial blowout mode during the heating operation, the airflow direction control section (91) sets the wind direction adjusting slats (51) of the two main outlet openings (24*b*, 24*d*) constituting the first opening (24X) to the horizontally blowing positions, and sets the wind direction adjusting slats (51) of the two main outlet openings (24*a*, 24*c*) constituting the second opening (24Y) to the airflow block positions. Thus, in the first partial blowout mode during the cooling operation, similarly to the first partial blowout mode during the heating operation, the conditioned air is blown out from the second main outlet opening (24*b*) and the fourth main outlet opening (24*d*) substantially in a horizontal direction at a higher flow speed than in the full blowout mode.

In the second partial blowout mode during the cooling operation, similarly to the second partial blowout mode during the heating operation, the airflow direction control section (91) sets the wind direction adjusting slats (51) of the two main outlet openings (24*a*,24*c*) constituting the first opening (24Y) to the horizontally blowing positions, and sets the wind direction adjusting slats (51) of the two main outlet openings (24*b*,24*d*) constituting the second opening (24X) to the airflow block positions. Thus, in the second partial blowout mode during the cooling operation, similarly to the second partial blowout mode during the heating operation, the conditioned air is blown out from the first main outlet opening (24*a*) and the third main outlet opening (24*c*) substantially in a horizontal direction at a higher flow speed than in the full blowout mode.

Note that, in any of the full blowout mode, the first partial blowout mode, and the second partial blowout mode, the subsidiary outlet openings (25*a* to 25*d*) blow out the conditioned air.

As illustrated in FIG. 9, in one cycle of the first blowing performed during the cooling operation, the first-time full blowout mode, the first partial blowout mode, the second-time full blowout mode, and the second partial blowout mode are sequentially performed. In one cycle of the first blowing mode during the cooling operation, the duration of each of the first and second-time full blowout modes is set longer than each of the duration of the first partial blowout mode and the duration of the second partial blowout mode. For example, the duration of each of the first and second-time full blowout modes is set to 600 seconds, and the duration of each of the first partial blowout mode and the duration of the second partial blowout mode is set to 120 seconds.

Note that, in one cycle of the first blowing mode during the cooling operation, the duration of the first-time full blowout mode, the duration of the first partial blowout mode, the duration of the second-time full blowout mode, and the duration of the second partial blowout mode may be set equal to each other.

<Temperature Distribution of Indoor Space in Cooling Operation>

The temperature distribution in the indoor space (500) during the cooling operation will be described with reference to FIGS. 11A and 11B.

Figure 11B:
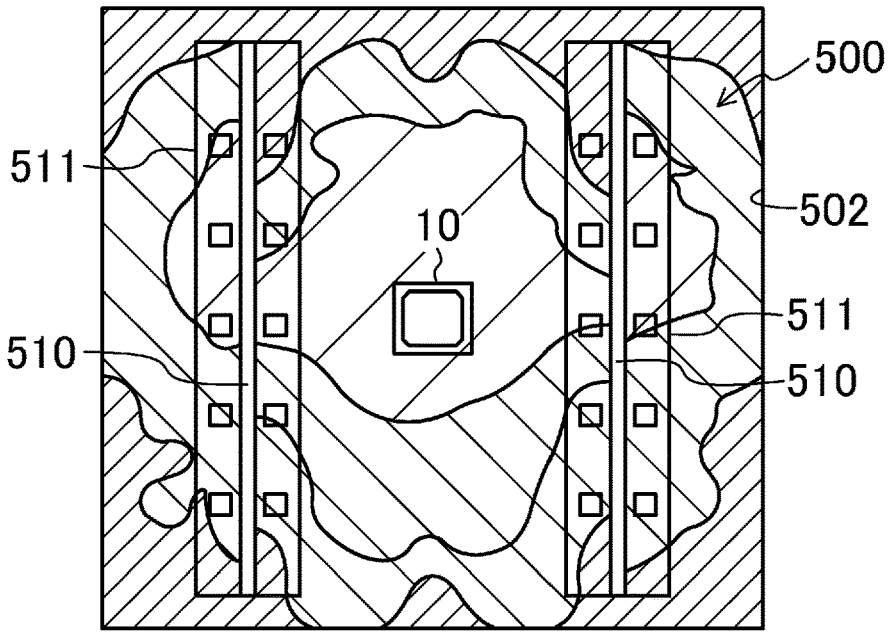
FIG. 11B is a plan view of an indoor space, and shows the temperature distribution in a room in a state in which the indoor unit of the embodiment is performing airflow rotation during a cooling operation.

FIGS. 11A and 11B show simulation results of the temperature distribution of the indoor space (500) during the cooling operation of the indoor unit (10). FIGS. 11A and 11B show air temperatures at a position in which 20 minutes have passed after the indoor unit (10) started the cooling operation and which is away by 60 cm from a floor surface of the indoor space (500). In FIGS. 11A and 11B, a region having a higher hatching density has a lower air temperature.

Note that, in the room simulated, the floor surface is roughly squared, and two elongated desks (511) each having a partition (510) at the center are arranged in parallel. The indoor unit (10) is arranged approximately at the center of the ceiling of the indoor space (500).

First, the temperature distribution in the indoor space (500) in which a conventional indoor unit (610) is installed will be described with reference to FIG. 11A.

During the cooling operation, in the conventional indoor unit (610), the wind direction adjusting slats (51) of all the main outlet openings (24*a* to 24*d*) periodically move between the horizontally blowing position and the downward blowing position. Then, the conventional indoor unit (610) supplies the air cooled when passing through the indoor heat exchanger (32), from all the main outlet openings (24*a* to 24*d*) to the indoor space (500).

As illustrated in FIG. 11A, in the indoor space (500), a central region located below the indoor unit (610) has an extremely low air temperature. The cool conditioned air blown out from the indoor unit (610) has a lower temperature and a higher specific gravity than the air present in the indoor space (500). Thus, even if the wind direction adjusting slats (51) moves to change the directions of flow of the blowing air of the main outlet openings (24*a* to 24*d*), the conditioned air having a low temperature moves downward toward the floor surface. Thus, the cool conditioned air blown downward from the indoor unit (610) stays in the central region of the interior space (500) sandwiched between the two partitions (510). Consequently, the central region of the indoor space (500) presumably has an extremely low temperature.

On the other hand, in the indoor space (500), a peripheral region apart from the indoor unit (610) does not have a sufficiently decreased air temperature. This is presumably because the cool conditioned air blown out from the indoor unit (610) cannot reach an area close to a wall (502) over the partition (510).

Next, the temperature distribution in the indoor space (500) in which the indoor unit (10) of the embodiment is installed will be described with reference to FIG. 11B.

During the cooling operation, the indoor unit (10) of the embodiment performing the first blowing mode performs the first-time full blowout mode, the first partial blowout mode, the second-time full blowout mode, and the second partial blowout mode in order.

In the full blowout mode, the cool conditioned air blown out from the indoor unit (10) is supplied mainly to the central region of the indoor space (500) sandwiched between the two partitions (510). Thus, in the indoor space (500), the central region located below the indoor unit (10) has an decreased air temperature. Note that the full blowout mode is performed intermittently, and thus the central region of the indoor space (500) does not have an excessively decreased air temperature.

On the other hand, in the first partial blowout mode and the second partial blowout mode, the cool conditioned air blown out from the indoor unit (10) is blown out substantially in a horizontal direction at a higher flow speed than in the full blowout mode. Thus, in the first partial blowout mode and the second partial blowout mode, the cool conditioned air blown out from the indoor unit (10) flows above the partition (510) and then reaches the wall (502) of the indoor space (500). Thus, in the indoor space (500), the peripheral region apart from the indoor unit (10) also has an decreased air temperature.

The cool conditioned air blown out from the indoor unit (10) and reaching the wall (502) of the indoor space (500) flows along the floor from the wall (502), and thus an airflow is formed to cover the whole of the indoor space (500). Such an airflow is also formed such that the cool conditioned air spreads through the whole of the indoor space (500). Thus, an air temperature difference between the central section and the peripheral section of the indoor space (500) is reduced.

In this manner, when the indoor unit (10) of the embodiment performs the first blowing mode (i.e., the airflow rotation) during the cooling operation, the air temperature difference between the central section and the peripheral section of the space (500) is more significantly decreased than when the conventional indoor unit (610) performs the cooling operation.

<Second Blowing Mode>

Figure 12:
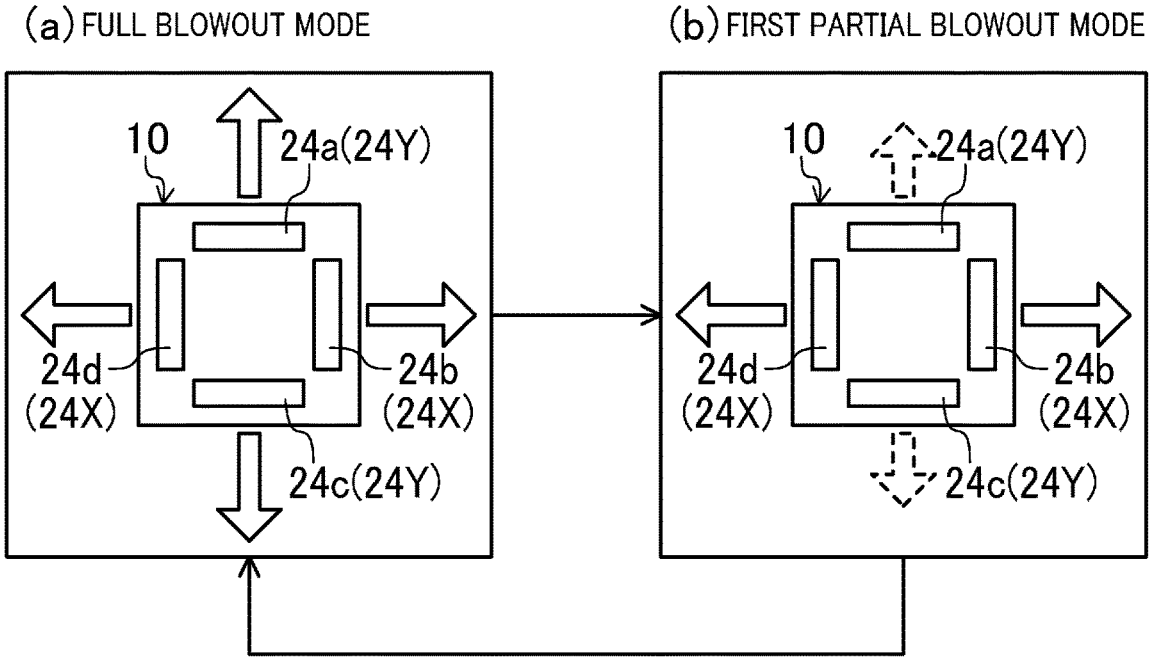
FIG. 12 is an explanatory view showing one cycle of a second blowing mode performed by the indoor unit, and schematically shows a lower surface of the indoor unit in each operation.

As illustrated in FIG. 12, in one cycle of the second blowing mode performed as the airflow rotation, the full blowout mode and the first partial blowout mode are sequentially performed. That is, in one cycle of the second blowing mode, one full blowout mode and one first partial blowout mode are performed.

<Second Blowing Mode in Heating Operation>

Similarly to the first blowing mode, in the full blowout mode during the heating operation, the airflow direction control section (91) sets the wind direction adjusting slats (51) of all the main outlet openings (24*a* to 24*d*) to the downward blowing positions. Similarly to the first blowing mode, in the first partial blowout mode during the heating operation, the airflow direction control section (91) sets the wind direction adjusting slats (51) of the two main outlet openings (24*b*, 24*d*) constituting the first opening (24X) to the horizontally blowing positions, and sets the wind direction adjusting slats (51) of the two main outlet openings (24*a*, 24*c*) constituting the second opening (24Y) to the airflow block positions.

Thus, during the heating operation, in the full blowout mode in the second blowing mode, the conditioned air is blown out from the indoor unit (10), similarly to the full blowout mode in the first blowing mode. In the first partial blowout mode in the second blowing mode, the conditioned air is blown out from the indoor unit (10), similarly to the first partial blowout mode in the first blowing mode.

In one cycle of the second blowing mode during the heating operation, the duration of the full blowout mode and the duration of the first partial blowout mode are set equal to each other (e.g., 120 seconds).

<Second Blowing Mode in Cooling Operation>

Similarly to the first blowing mode, in the full blowout mode during the cooling operation, the airflow direction control section (91) makes the wind direction adjusting slats (51) of all the main outlet openings (24*a* to 24*d*) move between the horizontally blowing position and the downward blowing position. Similarly to the first blowing mode, in the first partial blowout mode during the cooling operation, the airflow direction control section (91) sets the wind direction adjusting slats (51) of the two main outlet openings (24*b*, 24*d*) constituting the first opening (24X) to the horizontally blowing positions, and sets the wind direction adjusting slats (51) of the two main outlet openings (24*a*, 24*c*) constituting the second opening (24Y) to the airflow block positions.

Thus, during the cooling operation, in the full blowout mode in the second blowing mode, the conditioned air is blown out from the indoor unit (10), similarly to the full blowout mode in the first blowing mode. In the first partial blowout mode in the second blowing mode, the conditioned air is blown out from the indoor unit (10), similarly to the first partial blowout mode in the first blowing mode.

In one cycle of the second blowing mode during the cooling operation, the duration of the full blowout mode is set longer than the duration of the first partial blowout mode. For example, the duration of the full blowout modes is set to 600 seconds, and the duration of the first partial blowout mode is set to 120 seconds.

<Third Blowing Mode>

Figure 13:
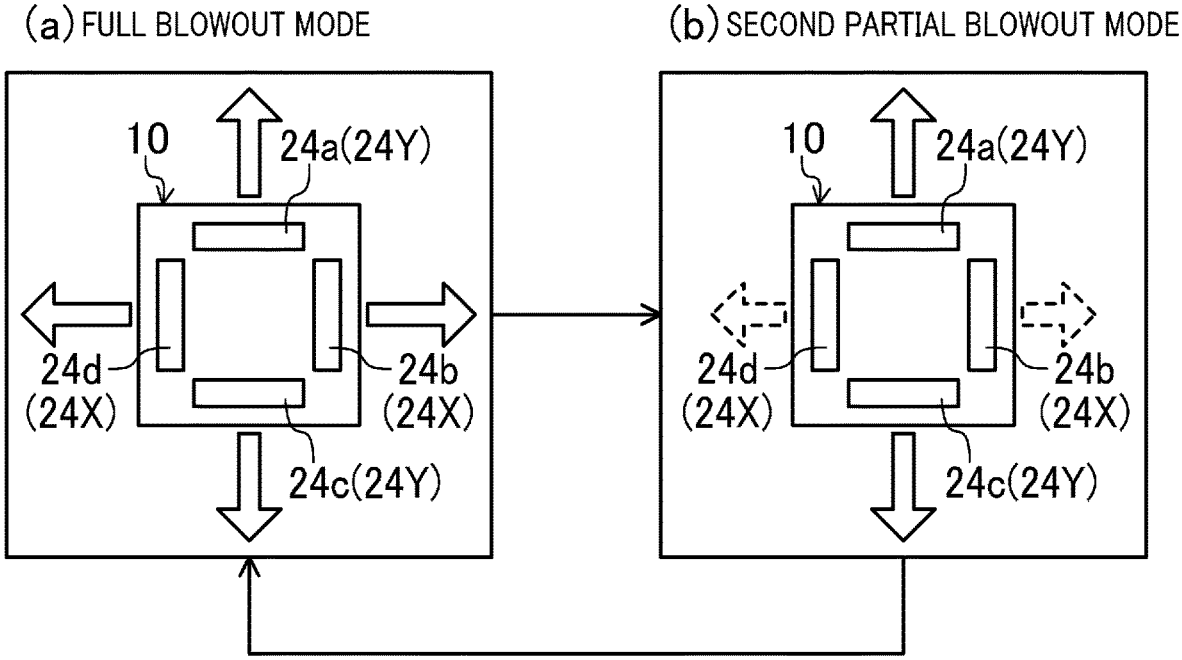
FIG. 13 is an explanatory view showing one cycle of a third blowing mode performed by the indoor unit, and schematically shows a lower surface of the indoor unit in each operation.

As illustrated in FIG. 13, in one cycle of the third blowing mode performed as the airflow rotation, the full blowout mode and the second partial blowout mode are sequentially performed. That is, in one cycle of the third blowing mode, one full blowout mode and one second partial blowout mode are performed.

<Third Blowing Mode in Heating Operation>

Similarly to the first blowing mode, in the full blowout mode during the heating operation, the airflow direction control section (91) sets the wind direction adjusting slats (51) of all the main outlet openings (24*a* to 24*d*) to the downward blowing positions. Similarly to the first blowing mode, in the second partial blowout mode during the heating operation, the airflow direction control section (91) sets the wind direction adjusting slats (51) of the two main outlet openings (24*a*,24*c*) constituting the first opening (24Y) to the horizontally blowing positions, and sets the wind direction adjusting slats (51) of the two main outlet openings (24*b*,24*d*) constituting the second opening (24X) to the airflow block positions.

Thus, during the heating operation, in the full blowout mode in the third blowing mode, the conditioned air is blown out from the indoor unit (10), similarly to the full blowout mode in the first blowing mode. In the second partial blowout mode in the third blowing mode, the conditioned air is blown out from the indoor unit (10), similarly to the second partial blowout mode in the first blowing mode.

In one cycle of the third blowing mode during the heating operation, the duration of the full blowout mode and the duration of the second partial blowout mode are set equal to each other (e.g., 120 seconds).

<Third Blowing Mode in Cooling Operation>

Similarly to the first blowing mode, in the full blowout mode during the cooling operation, the airflow direction control section (91) makes the wind direction adjusting slats (51) of all the main outlet openings (24*a* to 24*d*) move between the horizontally blowing position and the downward blowing position. Similarly to the first blowing mode, in the second partial blowout mode during the cooling operation, the airflow direction control section (91) sets the wind direction adjusting slats (51) of the two main outlet openings (24*a*,24*c*) constituting the first opening (24Y) to the horizontally blowing positions, and sets the wind direction adjusting slats (51) of the two main outlet openings (24*b*,24*d*) constituting the second opening (24X) to the airflow block positions.

Thus, during the cooling operation, in the full blowout mode in the third blowing mode, the conditioned air is blown out from the indoor unit (10), similarly to the full blowout mode in the first blowing mode. In the second partial blowout mode in the third blowing mode, the conditioned air is blown out from the indoor unit (10), similarly to the second partial blowout mode in the first blowing mode.

In one cycle of the third blowing mode during the cooling operation, the duration of the full blowout mode is set longer than the duration of the second partial blowout mode. For example, the duration of the full blowout modes is set to 600 seconds, and the duration of the second partial blowout mode is set to 120 seconds.

—Operation of Indoor Temperature Control Unit—

The indoor temperature control unit (92) of the controller (90) performs a temperature control operation. In the temperature control operation, the indoor temperature control unit (92) uses a measured value of the suction temperature sensor (61) as an index temperature Ti and uses the set temperature Ts stored in a memory of the controller (90). The set temperature Ts is input to the memory of the controller (90) when the user of the air conditioner operates a remote controller or the like.

The indoor temperature control unit (92) switches the operation state of the indoor unit (10) between the temperature adjusting state and the pausing state to change the index temperature Ti to the set temperature Ts. Specifically, the indoor temperature control unit (92) switches the operation state of the indoor unit (10) between the temperature adjusting state and the pausing state to make the index temperature Ti within the target temperature range (e.g., (Ts−1)° C. or more and (Ts+1)° C. or less) in which the set temperature Ts is centered.

When, during the cooling operation of the indoor unit (10), the operation state of the indoor unit (10) is the temperature adjusting state and the index temperature Ti is below (Ts−1)° C. (i.e., Ti<Ts−1), the control unit (92) switches the operation state of the indoor unit (10) from the temperature adjusting state to the pausing state to prevent the indoor space (500) from having an excessively decreased air temperature. When, during the cooling operation of the indoor unit (10), the operation state of the indoor unit (10) is the pausing state and the index temperature Ti exceeds (Ts+1)° C. (i.e., Ts+1<Ti), the indoor temperature controller (92) switches the operation state of the indoor unit (10) from the pausing state to the temperature adjusting state to make the indoor space (500) have a decreased air temperature.

When, during the heating operation of the indoor unit (10), the operation state of the indoor unit (10) is the temperature adjusting state and the index temperature Ti exceeds (Ts+1)° C. (i.e., Ts+1<Ti), the control unit (92) switches the operation state of the indoor unit (10) from the temperature adjusting state to the pausing state to prevent the indoor space (500) from having an excessively increased air temperature. When, during the heating operation of the indoor unit (10), the operation state of the indoor unit (10) is the pausing state and the index temperature Ti is below (Ts−1)° C. (i.e., Ti<Ts−1), the indoor temperature controller (92) switches the operation state of the indoor unit (10) from the pausing state to the temperature adjusting state to make the indoor space (500) have an increased air temperature.

Note that the indoor temperature control unit (92) is prohibited from switching the operation state from the pausing state to the temperature adjusting state until a predetermined time (e.g., 5 minutes) elapses after the operation state of the indoor unit (10) is switched from the temperature adjusting state to the pausing state. This avoids frequent activation and stop of the compressor provided in the outdoor unit and prevents failure of the compressor in advance.

—Operation of Blowing Mode Determination Section—

The blowing mode determination section (93) of the controller (90) performs a mode determining operation. This mode determining operation is performed when the indoor temperature control unit (92) switches the operation state of the indoor unit (10) from the pausing state to the temperature adjusting state.

In the mode determining operation, the blowing mode determination section (93) uses the measured value Tr of the suction temperature sensor (61) and the set temperature Ts stored in the memory of the controller (90).

The blowing mode determination section (93) uses a reference temperature difference ΔT0 (e.g., 3° C.) stored in the memory of the controller (90) as a determination reference value. The reference temperature difference ΔT0 is set to a value larger than a difference between the upper limit value or the lower limit value of the target temperature range and the set temperature (1° C. in the embodiment).

Moreover, as an air conditioning load index indicating an air conditioning load in the indoor space (500), the blowing mode determination section (93) uses, during the cooling operation, a cooling operation temperature difference ΔTc (=Tr−Ts) obtained through subtraction of the set temperature Ts from the measured value Tr of the suction temperature sensor (61), and uses, during the heating operation, a heating operation temperature difference ΔTh (=Ts−Tr) obtained through subtraction of the measured value Tr of the suction temperature sensor (61) from the set temperature Ts. The cooling operation temperature difference ΔTc increases as the cooling load in the room increases, and the heating operation temperature difference ΔTh increases as the heating load in the room increases.

When the indoor temperature control unit (92) decides to switch the operation state of the indoor unit (10) from the pausing state to the temperature adjusting state, the blowing mode determination section (93) compares the air conditioning load index with the determination reference value. Specifically, the blowing mode determination section (93) compares the cooling operation temperature difference ΔTc with the reference temperature difference ΔT0 during the cooling operation, and compares the heating operation temperature difference ΔTh with the reference temperature difference ΔT0 during the heating operation.

<Air Conditioning Load Index≤Determination Reference Value>

When the air conditioning load index is less than or equal to the determination reference value (i.e., when ΔTc≤ΔT0 during the cooling operation and when ΔTh≤ΔT0 during the heating operation), it can be determined that the air conditioning load in the indoor space (500) is relatively small. Thus, in this case, the blowing mode determination section (93) determines that the blowing mode to be executed by the indoor unit (10) of which the operation state is switched from the pausing state to the temperature adjusting state is the standard blowing mode.

Subsequently, the blowing mode determination section (93) outputs a command signal to the airflow direction control section (91), the command signal instructing the indoor unit (10) to execute the standard blowing mode. The airflow direction control section (91) having received the command signal from the blowing mode determination section (93) controls the wind direction adjusting slats (51) of the main outlet openings (24*a* to 24*d*) to allow the indoor unit (10) to execute the standard blowing mode. As a result, the indoor unit (10) of which the operation state has been switched from the pausing state to the temperature adjusting state executes the standard blowing mode.

The standard blowing mode is an operation mode in which the indoor unit (10) always performs the full blowout mode. Thus, in the indoor unit (10), the conditioned air having an adjusted temperature is blown out from all the main outlet openings (24*a* to 24*d*). During the heating operation, the airflow direction control section (91) sets the wind direction adjusting slats (51) of all the main outlet openings (24*a* to 24*d*) to the downward blowing position. During, the cooling operation, the airflow direction control section (91) moves the wind direction control blades (51) of all the main outlet openings (24*a* to 24*d*) between the horizontally blowing position and the downward blowing position.

<Determination Reference Value<Air Conditioning Load Index>

When the air conditioning load index exceeds the determination reference value (i.e., when ΔT0<ΔTc during the cooling operation and when ΔT0<ΔTh during the heating operation), it can be determined that the air conditioning load in the indoor space (500) is relatively large. Thus, in this case, the blowing mode determination section (93) determines that the blowing mode to be executed by the indoor unit (10) of which the operation state is switched from the pausing state to the temperature adjusting state is the airflow rotation.

As described above, the blowing mode of the indoor unit (10) as the airflow rotation among the first blowing mode, the second blowing mode, and the third blowing mode is set in advance by an installation operator or a maintenance operator of the indoor unit (10) by operating the dip switch of the controller (90). The blowing mode determination section (93) outputs a command signal to the airflow direction control section (91), the command signal instructing the indoor unit (10) to execute any one of the first blowing mode, the second blowing mode, and the third blowing mode set in advance as the airflow rotation.

The airflow direction control section (91) having received the command signal from the blowing mode determination section (93) controls the wind direction adjusting slats (51) of the main outlet openings (24*a* to 24*d*) to allow the indoor unit (10) to execute any one of the first blowing mode, the second blowing mode, and the third blowing mode. As a result, the indoor unit (10) of which the operation state has been switched from the pausing state to the temperature adjusting state executes the airflow rotation.

In any of the first blowing mode, the second blowing mode, and the third blowing mode performed as the airflow rotation by the indoor unit (10), the partial blowout mode is performed. That is, in the first blowing mode, the first partial blowout mode and the second partial blowout mode are performed. In the second blowing mode, the first partial blowout mode is performed. In the third blowing mode, the second partial blowout mode is performed. Compared with the full blowout mode, these partial blowout modes enable the conditioned air to be supplied to an area relatively far from the indoor unit (10) in the indoor space (500).

Thus, when the air conditioning load index exceeds the determination reference value and it can be determined that the indoor air conditioning load is relatively large, the indoor unit (10) is caused to execute the airflow rotation so that the partial blowout mode performed in the airflow rotation allows the conditioned air to be supplied to an area relatively far from the indoor unit (10) in the indoor space (500). As a result, the whole air temperature of the interior space (500) can promptly approach the set temperature.

Advantages of Embodiment

The airflow rotation performed by the indoor unit (10) of the embodiment includes the full blowout mode in which the conditioned air is supplied to the area relatively close to the indoor unit (10) in the indoor space (500), and the first partial blowout mode or the second partial blowout mode in which the conditioned air is supplied to the area relatively far from the indoor unit (10) in the indoor space (500). The conditioned air can be supplied to the area relatively close to the indoor unit (10) and the area relatively far from the indoor unit (10) in the indoor space (500), and thus an air temperature difference among parts of the indoor space (500) can be reduced.

Here, in the first partial blowout mode and the second partial blowout mode, the blowing wind speed is higher than in the full blowout mode, and the blowing air might directly hit a body of a person in the room. However, in the airflow rotation, the indoor unit (10) does not continue to execute the first partial blowout mode or the second partial blowout mode, but switches the blowout mode between either or both the first partial blowout mode or/and the second partial blowout mode and the full blowout mode. Thus, the person in the room feels less uncomfortable in this case than in the case in which the blowing air directly hits the body of the person in the room for a long time. Thus, according to the embodiment, the person in the room feels less uncomfortable due to the blowing air, and the air temperature difference among parts of the indoor space (500) is reduced so that the comfortability can be improved.

In the first blowing mode performed as the airflow rotation by the indoor unit (10) of the embodiment, the full blowout mode is performed between the first partial blowout mode and the second partial blowout mode. In other words, in the first blowing mode, the operation of supplying the conditioned air from one of the first opening (24X) and the second opening (24Y) to the indoor space (500) (i.e., the first partial blowout mode or the second partial blowout mode) is performed, and subsequently the full blowout mode of supplying the conditioned air from both the first opening (24X) and the second opening (24Y) to the indoor space (500) is performed.

In this manner, in the embodiment, the full blowout mode is performed twice in one cycle of the first blowing mode. In the first blowing mode of the embodiment, only one of the first partial blowout mode and the second partial blowout mode is performed between one full blowout mode and the next full blowout mode. Thus, a sufficient supply amount of the warm conditioned air to the vicinity of the floor surface of the indoor space (500) can be secured. Thus, in the embodiment, even when the outside air temperature is relatively low, the temperature around the floor surface of the indoor space (500) (i.e., the temperature around the foot of the person in the room) can be securely increased. As a result, the comfort in the indoor space (500) can be sufficiently secured.

The indoor unit (10) of the embodiment during the heating operation blows the conditioned air downward from the first opening (24X) and the second opening (24Y) during the full blowout mode in which the blowing wind speed is relatively low, and also blows the conditioned air in a substantially horizontal direction from the first opening (24X) or the second opening (24Y) during the first partial blowout mode and the second partial blowout mode in which the blowing wind speed is relatively high. Thus, during the heating operation, it is possible to reduce the air temperature difference among parts of the indoor space (500) to improve the comfort of the indoor space (500) without discomfort that the blowing air causes by directly hitting the body of the person in the room.

The indoor unit (10) of the embodiment during the cooling operation changes the directions of flow of the blowing air of the first opening (24X) and the second opening (24Y) during the full blowout mode in which the blowing wind speed is relatively low, and also blows the conditioned air in a substantially horizontal direction from the first opening (24X) or the second opening (24Y) during the first partial blowout mode and the second partial blowout mode in which the blowing wind speed is relatively high. Thus, during the cooling operation, it is possible to reduce the air temperature difference among parts of the indoor space (500) to improve the comfort of the indoor space (500) without discomfort that the blowing air causes by directly hitting the body of the person in the room.

In the indoor unit (10) of the embodiment, the directions of the flow of the blowing air of the outlet openings (24*a* to 24*d*) are different from each other. The indoor unit (10) of the embodiment can blow the conditioned air in the directions (i.e., the four directions) each orthogonal to the respective side of the decorative panel (22). Thus, in the embodiment, the conditioned air can be reliably supplied to the areas around the indoor unit (10) in the indoor space (500).

Meanwhile, if the wind direction control blades (51) of the main outlet openings (24*a* to 24*d*) are set at the airflow block position for a long time during the cooling operation, dew condensation occurs on the surfaces of the wind direction control blades (51), and water droplets might falls from the wind direction control blades (51). This problem will be described with reference to FIG. 8.

When the wind direction adjusting slat (51) is set at the airflow block position shown in FIG. 8, the conditioned air flowing out from the main outlet openings (24*a* to 24*d*) flows along the whole of the surface (a raised surface on the right side in FIG. 8) of the wind direction adjusting slat (51). Thus, the temperature of the wind direction adjusting slat (51) is approximately equal to that of the low temperature conditioned air. The conditioned air flowing out from the main outlet openings (24*a* to 24*d*) comes off from a middle of a back surface (a recessed surface on the left side in FIG. 8) of the wind direction adjusting slat (51). Thus, the wind direction adjusting slat (51) includes the back surface having the region close to the tip (the lower end in FIG. 8), the region coming into contact with the indoor air having a relatively high humidity. Then, the water vapor in the air condenses in this region. If this state continues for a long time (e.g., 5 minutes or more) and the amount of the condensed water generated on the back surface of the wind direction adjusting slat (51) reaches a certain amount or more, the condensed water might drop as water droplets.

To address this problem, in the indoor unit (10) of the embodiment, in all of the first to third blowing modes performed as the airflow rotation, the duration of the partial blowout mode in which the wind direction adjusting slat (51) of any of the main outlet openings (24*a* to 24*d*) is set to the air flow block position is set to a relatively short time (120 seconds in the embodiment). Thus, in the embodiment, the droplets can be prevented in advance from falling from the wind direction adjusting slat (51) set at the airflow block position.

First Variation of Embodiment

In the indoor unit (10) of the embodiment, a fourth blowing mode in which one full blowout mode, one first partial blowout mode, and one second partial blowout mode are performed repeatedly may be configured to be executable instead of the first blowing mode or in addition to the first to third blowing modes. This fourth blowing mode is executed as the airflow rotation.

Figure 14:
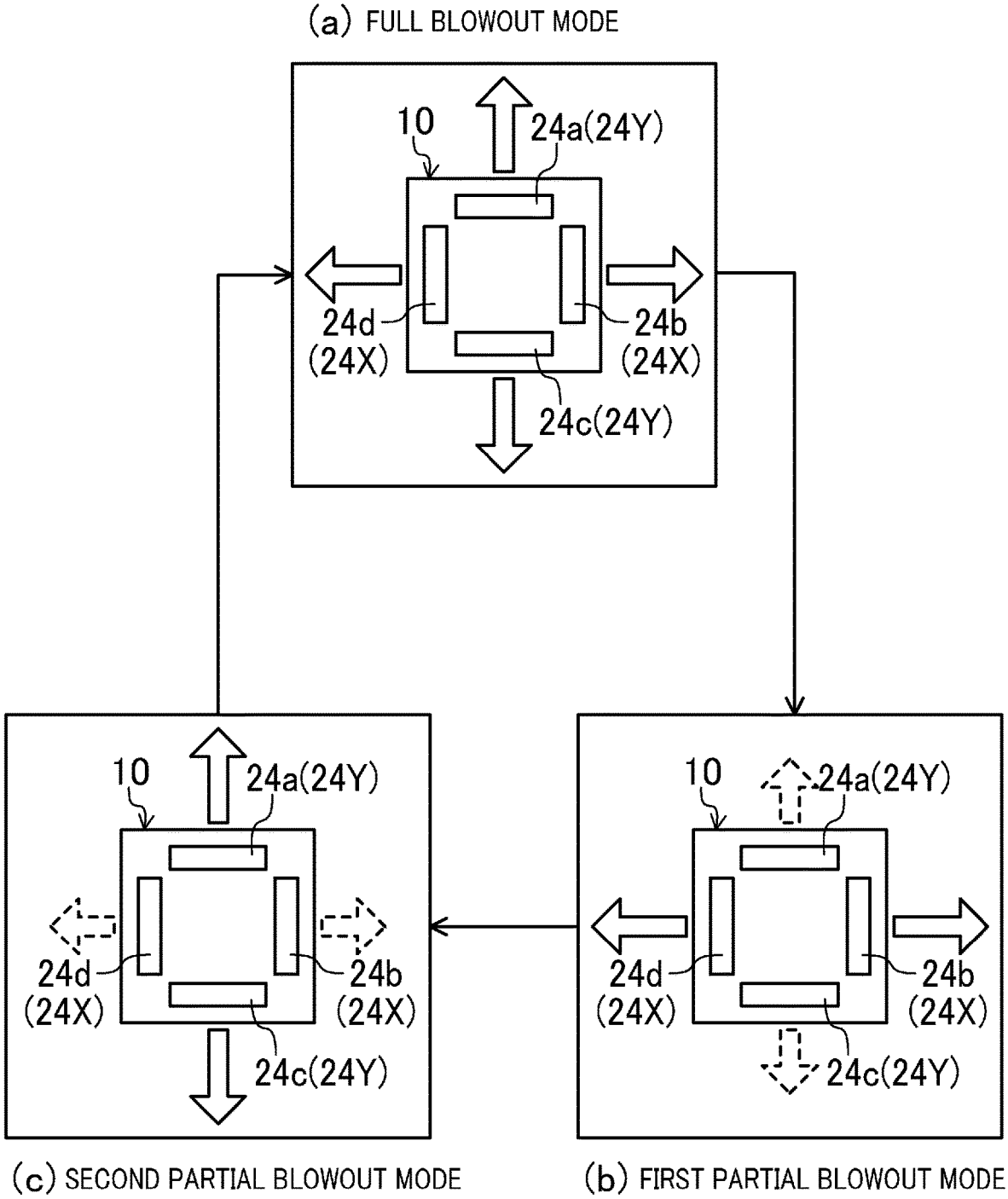
FIG. 14 is an explanatory view showing one cycle of a fourth blowing mode performed by an indoor unit of a first variation of the embodiment, and schematically shows a lower surface of the indoor unit in each operation.

As illustrated in FIG. 14, the indoor unit (10) performing the fourth blowing mode of this variation repeatedly performs the full blowout mode, the first partial blowout mode, and the second partial blowout mode in order. In one cycle of the fourth blowing mode, one full blowout mode, one first partial blowout mode, and one second partial blowout mode are performed. Note that, as the fourth blowing mode, the indoor unit (10) of this variation may perform an operation of repeatedly performing the full blowout mode, the second partial blowout mode, and the first partial blowout mode in order.

In one cycle of the fourth blowing mode during the heating operation, the duration of the full blowout mode, the duration of the first partial blowout mode, and the duration of the second partial blowout mode are set as the same duration (e.g., 120 seconds). In one cycle of the fourth blowing mode during the cooling operation, the duration of the full blowout mode is set longer than the duration of the first partial blowout mode and the duration of the second partial blowout mode. For example, the duration of the full blowout mode is set to 600 seconds, and the duration of the first partial blowout mode and the duration of the second partial blowout mode are set to 120 seconds.

For example, suppose that the cooling operation is performed in a state in which the outside air temperature is not so high. In this case, even if the first partial blowout mode and the second partial blowout mode are performed continuously, the air temperature of the region, in the indoor space (500), relatively close to the indoor unit (10) does not increase so much. Suppose that the heating operation is performed in a state in which the outside air temperature is not so low. In this case, even if the first partial blowout mode and the second partial blowout mode are performed continuously, the air temperature of the region, in the indoor space (500), relatively close to the indoor unit (10) does not decrease so much. Thus, as in this variation, in the one cycle of the airflow rotation, one full blowout mode, one first partial blowout mode, and one second partial blowout mode may be performed if the air conditioning load is relatively low.

Second Variation of Embodiment

As the first partial blowout mode and the second partial blowout mode, the indoor unit (10) of the embodiment may perform an operation of supplying the conditioned air from the adjacent two of the main outlet openings (24*a* to 24*d*) to the indoor space (500). In this variation, the first main outlet opening (24*a*) and the second main outlet opening (24*b*) constitute the first opening, (24X), and the third main outlet opening (24*c*) and the fourth main outlet opening (24*d*) constitute the second opening (24Y).

In the first partial blowout mode of this variation, the airflow direction control section (91) sets the wind direction adjusting slat (51) of the first main outlet opening (24*a*) and the wind direction adjusting slat (51) of the second main outlet opening (24*b*) to the horizontally blowing positions, and sets the wind direction adjusting slat (51) of the third main outlet opening (24*c*) and the wind direction adjusting slat (51) of the fourth main outlet opening (24*d*) to the airflow block positions. Thus, the conditioned air is blown out from the first main outlet opening (24*a*) and the second main outlet opening (24*b*) to the indoor space (500), and substantially not blown out from the third main outlet opening (24*c*) and the fourth main outlet opening (24*d*) to the indoor space (500).

In the second partial blowout mode of this variation, the airflow direction control section (91) sets the wind direction adjusting slat (51) of the third main outlet opening (24*c*) and the wind direction adjusting slat (51) of the fourth main outlet opening (24*d*) to the horizontally blowing positions, and sets the wind direction adjusting slat (51) of the first main outlet opening (24*a*) and the wind direction adjusting slat (51) of the second main outlet opening (24*b*) to the airflow block positions. Thus, the conditioned air is blown out from the third main outlet opening (24*c*) and the fourth main outlet opening (24*d*) to the indoor space (500), and substantially not blown out from the first main outlet opening (24*a*) and the second main outlet opening (24*b*) to the indoor space (500).

Third Variation of Embodiment

In the indoor unit (10) of the embodiment, a fifth blowing, mode in which the first partial blowout mode and the second partial blowout mode are performed alternately and repeatedly may be configured to be executable in addition to the first to third blowing modes. This fifth blowing mode is executed as the airflow rotation.

Figure 15:
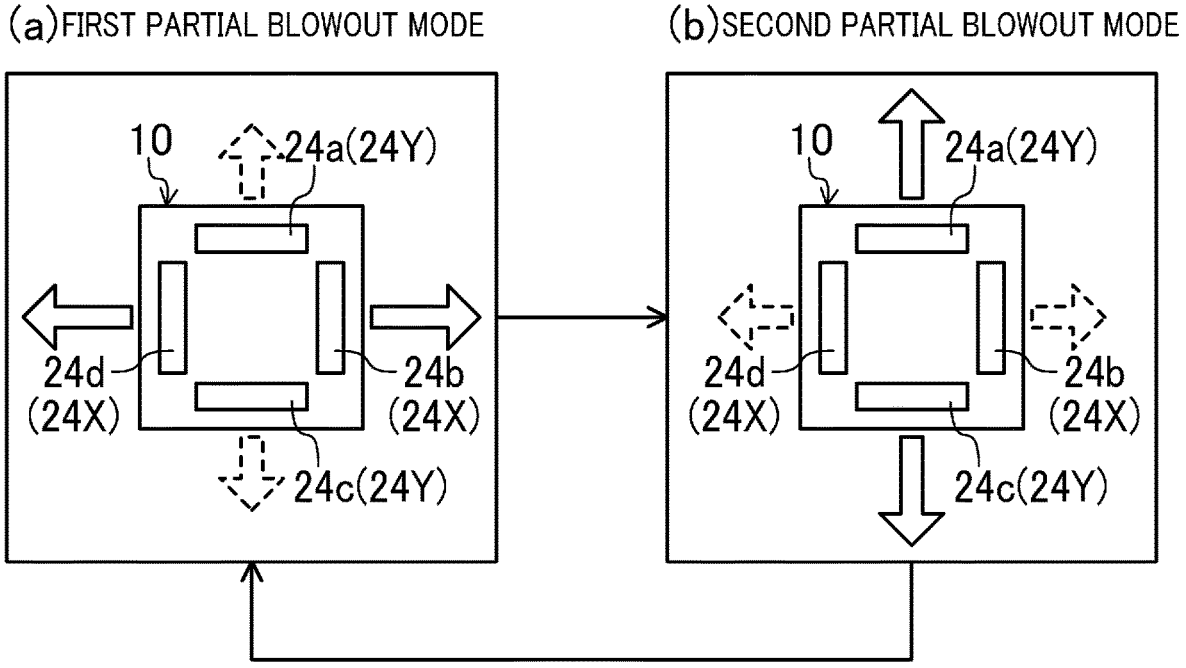
FIG. 15 is an explanatory view showing one cycle of a fifth blowing mode performed by an indoor unit of a third variation of the embodiment, and schematically shows a lower surface of the indoor unit in each operation.

As illustrated in FIG. 15, in one cycle of the fifth blowing mode, one first partial blowout mode and one second partial blowout mode are performed. In either one of the heating operation and the cooling operation, in one cycle of the fifth blowing mode, the duration of the first partial blowout mode and the duration of the second partial blowout mode are set as the same duration.

Fourth Variation of Embodiment

In the indoor unit (10) of the embodiment, the position of the wind direction adjusting slat (51) of the main outlet opening (24*a* to 24*d*) might be set to be more downward than the horizontally blowing position during the heating operation. For example, in the full blowout mode during the heating operation, the wind direction adjusting slats (51) of all the main outlet openings (24*a* to 24*d*) are set to the downward blowing positions. In this state, if the temperature of the conditioned air blown out from the indoor unit (10) decreases, the conditioned air which is not so warm directly hits the person in the room, and the person might feel uncomfortable.

To address this problem, the controller (90) of the indoor unit (10) of this variation is configured to perform a forcibly changing operation of forcibly changing the position of the wind direction adjusting slat (51) to the horizontal blow position if the assessment temperature falls below the reference value during the heating operation. The controller (90) of this variation uses the measured value of the suction temperature sensor (61) as the assessment temperature to perform the forcibly changing operation.

In a state in which the position of the wind direction adjusting slat (51) is set to be more downward than the horizontally blowing position during the heating operation, the controller (90) of this variation compares the measured value of the heat exchanger temperature sensor (62) with a predetermined reference value (e.g., 30° C.). Then, if the measured value of the heat exchanger temperature sensor (62) is more than or equal to the reference value, the controller (90) of this variation keeps the position of the wind direction adjusting slat (51). If the measured value of the heat exchanger temperature sensor (62) is less than the reference value, the controller (90) of this variation forcibly changes the position of the wind direction adjusting slat (51) to the horizontally blowing position.

Note that the controller (90) of this variation may be configured to use, as the assessment temperature, an actual measured value of the temperature of the conditioned air blown out from the air outlet (26) to the indoor space (500) to perform the forcibly changing operation. In this case, the controller (90) of this variation compares the actual measured value of the temperature of the conditioned air blown out from the air outlet (26) to the indoor space (500) with the predetermined reference value, and performs the above-described operation depending on the result.

Fifth Variation of Embodiment

The indoor unit (10) of the embodiment may be configured to automatically select the blowing mode performed as the airflow rotation.

Figure 16:
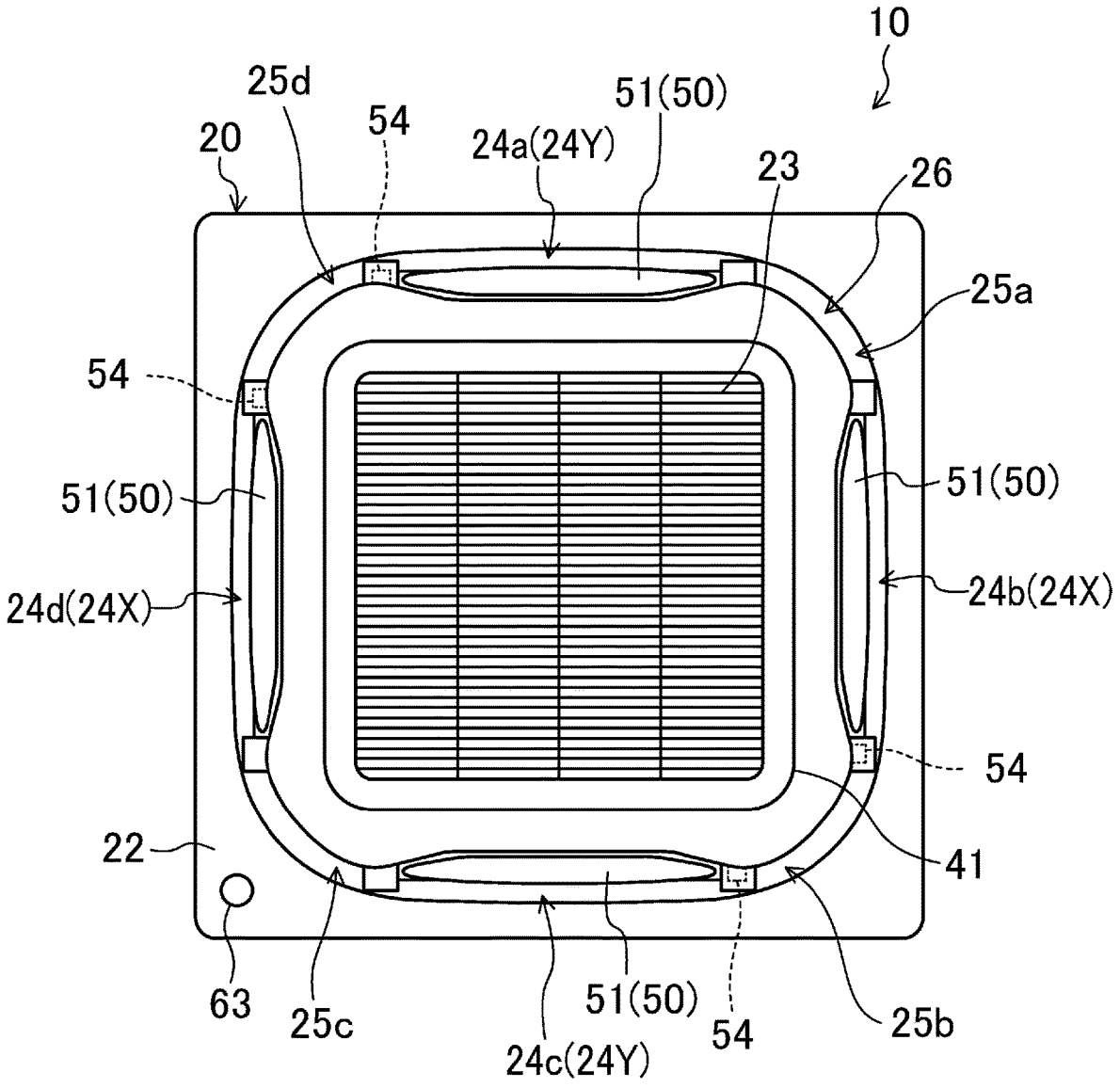
FIG. 16 is a schematic bottom view of an indoor unit of a fifth variation of the embodiment.

As illustrated in FIG. 16, the indoor unit (10) of this variation includes a distance sensor (63) measuring a distance from the indoor unit (10) to a wall surface of the room. An example of this distance sensor (63) includes a sensor that measures a distance based on time that an irradiated ultrasonic wave spends to reflect on the wall surface and return to the sensor.

The distance sensor (63) provided in the indoor unit (10) of this variation includes four sensor units (not shown) to measure distances in four directions. Specifically, the distance sensor (63) individually measures a distance to a wall surface located in a blowing direction (an upward direction in FIG. 16) of the first main outlet opening (24*a*), a distance to a wall surface located in a blowing direction (an right direction in FIG. 16) of the second main outlet opening (24*b*), a distance to a wall surface located in a blowing direction (a downward direction in FIG. 16) of the third main outlet opening (24*c*), and a distance to a wall surface located in a blowing direction (an left direction in FIG. 16) of the fourth main outlet opening (24*c*).

The distance from the wall surface located in the blowing direction of the third main outlet opening (24*c*) to the indoor unit (10) and the distance from the wall surface located in the blowing direction of the fourth main outlet opening (24*d*) to the indoor unit (10) is substantially equal to the measured value of the distance sensor (63). On the other hand, the distance from the wall surface located in the blowing direction of the first main outlet opening (24*a*) to the indoor unit (10) and the distance from the wall surface located in the blowing direction of the second main outlet opening (24*b*) to the indoor unit is substantially equal to a value obtained through subtraction of the length of one side of the decorative panel (22) from the measured value of the distance sensor (63).

Here, for example, if a plurality of indoor units (10) are installed in a large room, the distance, to the indoor units (10), from each of the wall surfaces located in the blowing direction of the conditioned air blowing out from each of the main outlet openings (24*a* to 24*d*) is not necessarily coincident with each other. Suppose that the conditioned air is blown out from the main outlet openings (24*a* to 24*d*) toward the wall surface of the room at a high flow speed. In this case, if the distance from the indoor unit (10) to the wall surface is long, the conditioned air does not reach the wall surface, and the air flow covering the indoor space might not be formed.

Thus, the controller (90) of the indoor unit (10) of this variation performs an automatically selecting operation of selecting the blowing mode performed as the airflow rotation based on the measured value of the distance sensor (63).

For example, the wall surface located in the blowing direction of the second main outlet opening (24*b*) and the wall surface located in the blowing direction of the fourth main outlet opening (24*d*) are relatively close to the indoor unit (10), whereas the wall surface located in the blowing direction of the first main outlet opening (24*a*) and the wall surface located in the blowing direction of the third main outlet opening (24*c*) are apart from the indoor unit (10).

In this case, in the first partial blowout mode for increasing the blowing wind speeds of the second main outlet opening (24*b*) and the fourth main outlet opening (24*d*), the conditioned air reaches the wall surface and the air flow covering the indoor space is formed. In contrast, in the second partial blowout mode for increasing the blowing wind speeds of the first main outlet opening (24*a*) and the third main outlet opening (24*c*), the conditioned air cannot reach the wall surface, and the air flow covering the indoor space is not formed.

Thus, in such a case, the controller (90) of this variation selects the second blowing mode shown in FIG. 12 as the airflow rotation performed by the indoor unit (10). In other words, in this case, the controller (90) of this variation selects the first partial blowout mode as a partial blowout mode executed in the airflow rotation. In this second blowing mode, the full blowout mode and the first partial blowout mode are alternately performed, and the second partial blowout mode in which the conditioned air cannot reach the wall surface is not performed.

If the distance from each of the wall surfaces located in the blowing directions of the conditioned air blown out from each of the main outlet openings (24*a* to 24*d*) to the indoor unit (10) is less than or equal to the predetermined reference distance, the controller (90) of this variation selects the first blowing mode shown in FIG. 9 as the airflow rotation performed by the indoor unit (10). In other words, in this case, the controller (90) of this variation selects both the first partial blowout mode and the second partial blowout mode as partial blowout modes executed in the airflow rotation.

Note that, if the distance from the wall surface to the indoor unit (10) exceeds the predetermined reference distance, the remote controller may display, on a screen, that an execution of the airflow rotation might not provide a sufficiently improved comfort in the indoor space (500), or that some of the plural types of the partial blowout modes that the indoor unit (10) can execute is prohibited.

Sixth Variation of Embodiment

The indoor unit (10) of the embodiment may be provided with a floor temperature sensor. An example of this floor temperature sensor includes a non-contact type temperature sensor for measuring a temperature based on the amount of infrared radiation emitted from the object.

In the indoor unit (10) of this variation, the indoor temperature control unit (92) of the controller (90) may use a measured value of the floor temperature sensor to perform a temperature control operation.

In this case, the indoor temperature control unit (92) uses an average value ((Ta+Tf)/2), as the index temperature Ti, of the measured value Ta of the suction temperature sensor (61) and the measured value Tf of the floor temperature sensor to perform the temperature control operation. That is, the indoor temperature control unit (92) switches the operation state of the indoor unit (10) between the temperature adjusting state and the pausing state to adjust the index temperature Ti (=(Ta+Tf)/2) to the set temperature Ts.

In the indoor unit (10) of this variation, the blowing mode determination section (93) of the controller (90) may use a measured value of the floor temperature sensor to perform the mode determining operation.

In this case, the blowing mode determination section (93) uses the air conditioning load index indicating the air conditioning load of the indoor space (500). During the cooling operation, a value (Tf−Tr) obtained through subtraction of the measured value Tr of the suction temperature sensor (61) from the measured value Tf of the floor temperature sensor is used as the air conditioning load index. During the heating operation, a value (Tr−Tf) obtained through subtraction of the measured value Tf of the floor temperature sensor from the measured value Tr of the suction temperature sensor (61) is used as the air conditioning load index. During the cooling operation, the air conditioning load index (Tf−Tr) increases as the cooling load in the room increases. During the heating operation, the air conditioning load index (Tr−Tf) increases as the heating load in the room increases.

If the indoor temperature control unit (92) decides to switch the operation state of the indoor unit (10) from the pausing state to the temperature adjusting state, the blowing mode determination section (93) compares the air conditioning load index with the determination reference value, and, based on the result, determines which one of the standard blowing mode and the airflow rotation the indoor unit (10) the indoor unit (10) is made execute.

Seventh Variation of Embodiment

Figure 17:
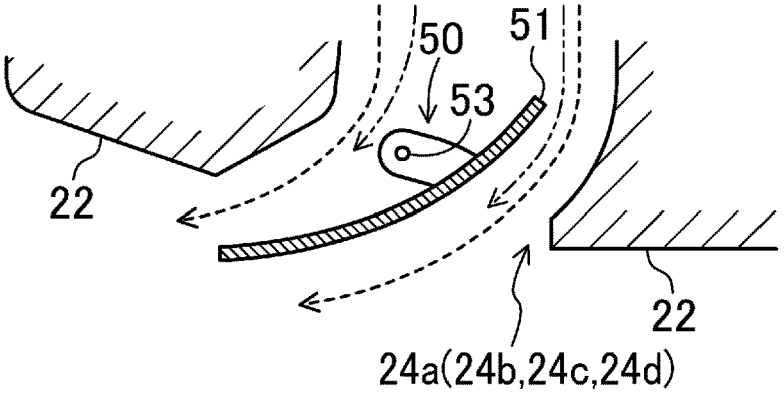
FIG. 17 is a cross-sectional view of a main part of a decorative panel of a seventh variation of the embodiment, and illustrates a wind direction adjusting slat in a horizontally blowing position.
Figure 18:
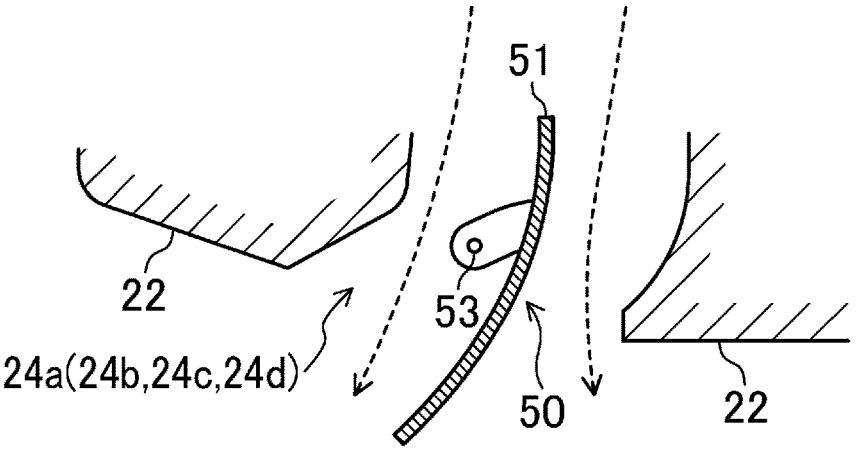
FIG. 18 is a cross-sectional view of the main part of the decorative panel of the seventh variation of the embodiment, and illustrates the wind direction adjusting slat in a downward blowing position.
Figure 19:
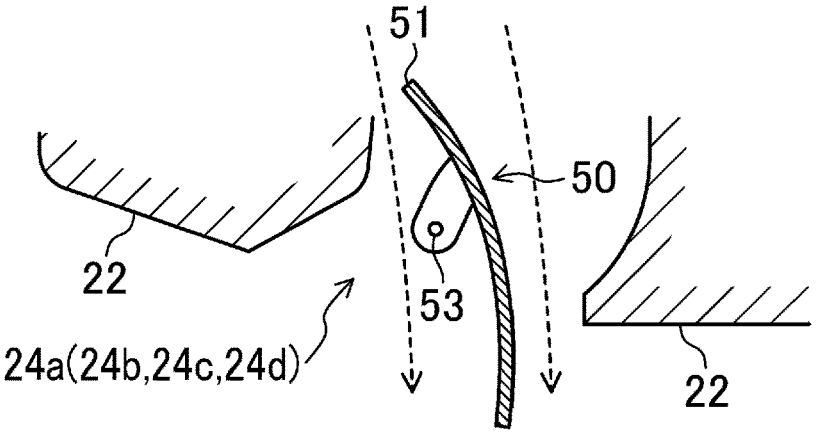
FIG. 19 is a cross-sectional view of the main part of the decorative panel of the seventh variation of the embodiment, and illustrates the wind direction adjusting slat in an airflow block position.

The indoor unit (10) of the embodiment may be provided with the air direction adjusting blade (51) having a wider width as illustrated in FIGS. 17 to 19. The wind direction adjusting slat (51) illustrated in FIGS. 17 to 19 has a center portion in the longitudinal direction thereof, the center portion having a width (i.e., a length in the direction orthogonal to the central axis (53)) that is wider than the wind direction adjusting slat (51) illustrated in FIGS. 6-8. The wind direction adjusting slat (51) having a wide width illustrated in FIGS. 17 to 19 can surely guide the flow of the conditioned air blown out from the main outlet openings (24*a* to 24*d*) in an intended direction.

Eighth Variation of Embodiment

The indoor unit (10) of the embodiment only have to have a plurality of main outlet openings (24*a* to 24*d*) provided with the wind direction adjusting slats (51), and the number of the main outlet openings (24*a* to 24*d*) is not limited to four. For example, if the indoor unit (10) is provided with two main outlet openings, the wind direction adjusting slat (51) blocks the flow of the blowing air of the first main outlet opening such that the indoor unit (10) performs the first partial blowout mode to increase the blowing wind speed at the second main outlet opening, and the wind direction adjusting slat (51) blocks the flow of the blowing air of the second main outlet opening such that the indoor unit (10) performs the second partial blowout mode to increase the blowing wind speed at the first main outlet opening.

Ninth Variation of Embodiment

The indoor unit (10) of the embodiment may include a shutter, as an air current blocking mechanism, for blocking the main outlet opening (24*a* to 24*d*). The indoor unit (10) of this variation includes four main outlet openings (24*a* to 24*d*) each having a shutter that can open and close.

Tenth Variation of Embodiment

The indoor unit (10) of the embodiment may be not a ceiling embedded type in which the indoor unit is embedded in the opening of the ceiling (501), but a ceiling hanging type in which the casing (20) is hung from the ceiling (501).

INDUSTRIAL APPLICABILITY

As described above, the present invention is useful for an indoor unit of an air conditioner installed on a ceiling.

DESCRIPTION OF REFERENCE CHARACTERS

10 Indoor Unit
20 Casing
24*a* First Main Outlet Opening
24*b* Second Main Outlet Opening
24*c* Third Main Outlet Opening
24*d* Fourth Main Outlet Opening
24X First Opening
24Y Second Opening
50 Airflow Blocking Mechanism
51 Airflow Direction Adjusting Blade
90 Controller
500 Indoor Space
501 Ceiling

The invention claimed is:

1. An indoor unit of an air conditioner installed on a ceiling and blowing conditioned air into an indoor space, the indoor unit comprising:

a plurality of outlet openings each provided with a wind direction adjusting slat configured to selectively block a flow of the blown conditioned air from the corresponding outlet opening; and a controller controlling the wind adjusting slats of the corresponding outlet openings to switchably block the flows of the blown conditioned air therefrom, in order to execute airflow rotation while repeatedly switching an operation between a full blowout mode of supplying the blown conditioned air from all the outlet openings to the indoor space, and a partial blowout mode of blocking the flow of the blown conditioned air of part of the outlet openings by corresponding ones of the wind direction adjusting slats, and increasing a blowing wind speed at the part of outlet openings, wherein the wind direction adjusting slat of each of the plurality of outlet openings is configured to selectively shift a direction of the flow of the blown conditioned air upward and downward; and the controller automatically controls the wind direction adjusting slats so that in a heating operation in which heated conditioned air is supplied to the indoor space, each of the wind direction adjusting slats is cycled through a sequence of positions such that the wind direction adjusting slat stops during a predetermined time of the cycle, and for a predetermined duration, in a position in which during the full blowout mode, the wind direction adjusting slat directs the flow of the blown conditioned air of the corresponding outlet opening downward, and the wind direction adjusting slat stops during another predetermined time of the cycle, and for the same predetermined duration, in another position in which during the partial blowout mode, the wind direction adjusting slat directs the flow of the blown conditioned air of the corresponding outlet opening, at which the blowing wind speed increases, horizontally.

2. The indoor unit of the air conditioner of claim 1, wherein the controller controls the wind direction adjusting slats of the corresponding outlet openings so that in a cooling operation in which cooled conditioned air is supplied to the indoor space, during the full blowout mode, the direction of the flow of the blown conditioned air of all the outlet openings varies, and during the partial blowout mode, the flow of the blown conditioned air of the outlet openings at which the blowing wind speed increases is directed horizontally.

3. The indoor unit of the air conditioner of claim 1, wherein part of the plurality of outlet openings constitutes a first opening, and the rest of the plurality of outlet openings constitutes a second opening; and the controller controls the corresponding wind direction adjusting slats of the plurality of outlet openings so that at least one of the following is performed in the airflow rotation:

a first partial blowout mode of blocking the flow of the blown conditioned air of the second opening and increasing a blowing wind speed at the first opening and a second partial blowout mode of blocking the flow of the blown conditioned air of the first opening and increasing a blowing wind speed at the second opening.

4. The indoor unit of the air conditioner of claim 3, wherein each of the first opening and the second opening includes a same number of the plurality of outlet openings.

5. The indoor unit of the air conditioner of claim 4, comprising:

a casing having a rectangular lower surface, wherein each of the plurality of outlet openings is arranged along a respective one of four sides of the lower surface of the casing; and the first opening comprises two of the plurality of outlet openings respectively arranged along two opposite sides among the four sides of the lower side of the casing, and the second opening comprises the remaining two of the plurality of outlet openings.

6. The indoor unit of the air conditioner of claim 1, wherein part of the plurality of outlet openings constitutes a first opening, and the rest of the plurality of outlet openings constitutes a second opening; and the controller controls the corresponding wind direction adjusting slats of the plurality of outlet openings so that the following are performed in the airflow rotation:

a first partial blowout mode of blocking the flow of the blown conditioned air of the second opening and increasing a blowing wind speed at the first opening and a second partial blowout mode of blocking the flow of the blown conditioned air of the first opening and increasing a blowing wind speed at the second opening.

7. The indoor unit of the air conditioner of claim 6, wherein each of the first opening and the second opening includes a same number of the plurality of outlet openings.

8. The indoor unit of the air conditioner of claim 7, comprising:

a casing having a rectangular lower surface, wherein each of the plurality of outlet openings is arranged along a respective one of four sides of the lower surface of the casing;

the first opening comprises two of the plurality of outlet openings respectively arranged along two opposite sides among the four sides of the lower side of the casing, and the second opening comprises the remaining two of the plurality of outlet openings.

9. An indoor unit of an air conditioner installed on a ceiling and blowing conditioned air into an indoor space, the indoor unit comprising:

a plurality of outlet openings each provided with a wind direction adjusting slat configured to selectively block a flow of the blown conditioned air from the corresponding outlet opening; and a controller controlling the wind adjusting slats of the corresponding outlet openings to switchably block the flows of the blown conditioned air therefrom, in order to execute airflow rotation while repeatedly switching an operation between a full blowout mode of supplying the blown conditioned air from all the outlet openings to the indoor space, and a partial blowout mode of blocking the flow of the blown conditioned air of part of the outlet openings by corresponding ones of the wind direction adjusting slats, and increasing a blowing wind speed at the part of outlet openings, wherein the wind direction adjusting slat of each of the plurality of outlet openings is configured to selectively shift a direction of the flow of the blown conditioned air upward and downward;

the controller controls the wind direction adjusting slat so that in a heating operation in which heated conditioned air is supplied to the indoor space, during the full blowout mode, the flow of the blown conditioned air of all the outlet openings is directed downward, and during the partial blowout mode, the flow of the blown conditioned air of the outlet openings at which the blowing wind speed increases is directed horizontally;

part of the plurality of outlet openings constitutes a first opening, and the rest of the plurality of outlet openings constitutes a second opening;

the controller controls the corresponding wind direction adjusting slats of the plurality of outlet openings so that the following are performed in the airflow rotation:

a first partial blowout mode of blocking the flow of the blown conditioned air of the second opening and increasing a blowing wind speed at the first opening and a second partial blowout mode of blocking the flow of the blown conditioned air of the first opening and increasing a blowing wind speed at the second opening; and the controller controls the corresponding wind direction adjusting slats of the plurality of outlet openings so that in the airflow rotation, the full blowout mode, the first partial blowout mode, the full blowout mode, and the second partial blowout mode are sequentially repeated.

10. The indoor unit of the air conditioner of claim 9, wherein the controller controls the corresponding wind direction adjusting slats of the plurality of outlet openings so that in the airflow rotation during the heating operation, duration of the full blowout mode, duration of the first partial blowout mode, and duration of the second partial blowout mode are equal to each other.

11. An indoor unit of an air conditioner installed on a ceiling and blowing conditioned air into an indoor space, the indoor unit comprising:

a plurality of outlet openings each provided with a wind direction adjusting slat configured to selectively block a flow of the blown conditioned air from the corresponding outlet opening; and a controller controlling the wind adjusting slats of the corresponding outlet openings to switchably block the flows of the blown conditioned air therefrom, in order to execute airflow rotation while repeatedly switching an operation between a full blowout mode of supplying the blown conditioned air from all the outlet openings to the indoor space, and a partial blowout mode of blocking the flow of the blown conditioned air of part of the outlet openings by corresponding one so the wind direction adjusting slats, and increasing a blowing wind speed at the part of outlet openings, wherein the wind direction adjusting slat of each of the plurality of outlet openings is configured to selectively shift a direction of the flow of the blown conditioned air upward and downward;

the controller controls the wind direction adjusting slat so that in a heating operation in which heated conditioned air is supplied to the indoor space, during the full blowout mode, the flow of the blown conditioned air of all the outlet openings is directed downward, and during the partial blowout mode, the flow of the blown conditioned air of the outlet openings at which the blowing wind speed increases is directed horizontally;

to adjust an index temperature serving as an index of a temperature of the indoor space to a set temperature, the controller switches an operation state of the indoor unit between a temperature adjusting state in which a temperature of the conditioned air is adjusted, and a pausing state in which adjustment of a temperature of the conditioned air is paused; and the controller further controls the corresponding wind direction adjusting slats of the plurality of outlet openings so that if an air conditioning load index indicating an air conditioning load in the indoor space is less than or equal to a predetermined determination reference value, the indoor unit of which the operation state has been switched from the pausing state to the temperature adjusting state executes a standard blowing mode of constant operation in the full blowout mode, and if the air conditioning load index exceeds the determination reference value, the indoor unit of which the operation state has been switched from the pausing state to the temperature adjusting state executes the airflow rotation.

* * * * *